US012065892B2

(12) United States Patent
De Mul et al.

(10) Patent No.: US 12,065,892 B2
(45) Date of Patent: Aug. 20, 2024

(54) DRILLING RIG WITH A TOP DRIVE SYSTEM OPERABLE IN A DRILLING MODE AND A TRIPPING MODE

(71) Applicant: ITREC B.V., Schiedam (NL)

(72) Inventors: Arthur Alexander De Mul, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 17/979,223

(22) Filed: Nov. 2, 2022

(65) Prior Publication Data

US 2023/0048765 A1 Feb. 16, 2023

Related U.S. Application Data

(62) Division of application No. 15/737,068, filed as application No. PCT/NL2016/050415 on Jun. 9, 2016, now Pat. No. 11,512,532.

(30) Foreign Application Priority Data

Jun. 18, 2015 (NL) ..... 2014988

(51) Int. Cl.
*E21B 19/14* (2006.01)
*E21B 3/02* (2006.01)
(Continued)

(52) U.S. Cl.
CPC ..... *E21B 19/14* (2013.01); *E21B 3/022* (2020.05); *E21B 7/02* (2013.01); *E21B 19/00* (2013.01); *E21B 19/06* (2013.01); *E21B 19/16* (2013.01)

(58) Field of Classification Search
CPC . E21B 19/14; E21B 3/022; E21B 7/02; E21B 19/00; E21B 19/06; E21B 19/16
See application file for complete search history.

(56) References Cited

U.S. PATENT DOCUMENTS 4,397,605 A * 8/1983 Cowgill ..... E21B 19/14 294/203
4,462,733 A * 7/1984 Langowski ..... E21B 19/14 414/22.71
(Continued)

FOREIGN PATENT DOCUMENTS

WO WO 89/07188 A1 8/1989
WO WO 2006/038790 A1 4/2006
(Continued)

OTHER PUBLICATIONS

International Search Report, issued in PCT/NL2016/050415, dated Oct. 5, 2016.
(Continued)

*Primary Examiner* — Tara Schimpf
*Assistant Examiner* — Neel Girish Patel
(74) *Attorney, Agent, or Firm* — Birch, Stewart, Kolasch & Birch, LLP

(57) ABSTRACT

In combination a drilling mast and a top drive system for a drilling rig having a drill floor with a well center. The drilling mast has a U-shaped horizontal cross section with a left-hand mast wall, a rear mast wall, and a right-hand mast wall, and with an open front side. Each of the mast walls is provided with one or more vertical rails that are, in use of the drilling rig, parallel to a vertical firing line that extends through the well center. The top drive system comprises a traveling carriage and a top drive unit supported by said carriage. A left-hand fingerboard device is mounted to the left-hand mast wall and a right-hand side fingerboard device is mounted to the right-hand mast wall.

10 Claims, 21 Drawing Sheets

(51) Int. Cl.

| | |
|---|---|
| ***E21B 7/02*** | (2006.01) |
| ***E21B 19/00*** | (2006.01) |
| ***E21B 19/06*** | (2006.01) |
| ***E21B 19/16*** | (2006.01) |

(56) References Cited

U.S. PATENT DOCUMENTS 4,696,207 A * 9/1987 Boyadjieff ..... E21B 19/20 414/22.71
4,709,766 A * 12/1987 Boyadjieff ..... E21B 19/14 414/22.71
4,765,401 A * 8/1988 Boyadjieff ..... E21B 19/20 414/22.71
4,850,439 A * 7/1989 Lund ..... E21B 19/20 175/57
6,926,103 B1 * 8/2005 Roodenburg ..... E21B 19/09 175/203
6,926,259 B1 * 8/2005 Roodenburg ..... E21B 19/02 254/338
7,331,746 B2 * 2/2008 Wright ..... E21B 19/20 414/23
7,712,523 B2 * 5/2010 Snider ..... E21B 21/02 166/380
8,127,836 B1 * 3/2012 Keast ..... E21B 19/16 166/85.4
8,684,336 B1 * 4/2014 Akerman ..... E21B 3/02 254/338
8,727,039 B1 * 5/2014 Keast ..... E21B 44/04 175/203
9,243,450 B1 * 1/2016 Barnes ..... E21B 3/02
2001/0025727 A1 * 10/2001 Byrt ..... E21B 19/143 175/85
2003/0111232 A1 * 6/2003 Welsh ..... E21B 19/02 166/77.51
2005/0126790 A1 * 6/2005 Beato ..... E21B 19/002 175/7
2006/0104747 A1 * 5/2006 Zahn ..... E21B 19/14 414/22.63
2006/0249292 A1 * 11/2006 Guidry ..... E21B 19/06 166/380
2007/0017704 A1 * 1/2007 Belik ..... E21B 19/155 175/85
2007/0074875 A1 * 4/2007 Beierbach ..... E21B 19/06 166/77.51
2007/0209791 A1 * 9/2007 Havinga ..... E21B 7/02 166/77.2
2007/0251700 A1 * 11/2007 Mason ..... E21B 19/165 166/380
2008/0164064 A1 * 7/2008 Belik ..... E21B 19/155 166/380
2008/0210416 A1 * 9/2008 Lesko ..... E21B 7/023 166/241.1
2009/0008081 A1 * 1/2009 Bouligny ..... E21B 19/16 166/380
2009/0257848 A1 * 10/2009 Stroshein ..... E21B 19/14 414/22.65
2011/0048310 A1 * 3/2011 Roodenburg ..... E21B 15/02 166/341
2012/0103623 A1 * 5/2012 Wijning ..... E21B 19/146 175/85
2012/0125692 A1 * 5/2012 Rodgers ..... E21B 3/02 175/114
2012/0160517 A1 * 6/2012 Bouligny ..... E21B 19/155 166/380
2012/0195716 A1 * 8/2012 Nouwens ..... E21B 19/155 414/22.55
2013/0269952 A1 * 10/2013 Robnett ..... E21B 19/155 166/377
2014/0097027 A1 * 4/2014 Marica ..... E21B 3/02 175/220
2015/0016925 A1 * 1/2015 Larkin ..... E21B 19/14 414/800
2016/0060979 A1 * 3/2016 Magnuson ..... E21B 19/14 414/800
2016/0160586 A1 * 6/2016 Keogh ..... E21B 19/24 414/800
2017/0234088 A1 * 8/2017 Orr ..... E21B 19/14 166/380
2017/0306710 A1 * 10/2017 Trydal ..... E21B 19/14
2018/0073306 A1 * 3/2018 Verhoef ..... E21B 47/12
2019/0106950 A1 * 4/2019 Alvaer ..... E21B 19/16
2019/0316421 A1 * 10/2019 Luo ..... E21B 7/023

FOREIGN PATENT DOCUMENTS

WO WO 2013/109147 A2 7/2013
WO WO 2013/109148 A2 7/2013
WO WO 2013/133698 A2 9/2013
WO WO 2014/133389 A2 9/2014
WO WO 2014/178709 A1 11/2014
WO WO 2014/178712 A1 11/2014

OTHER PUBLICATIONS

Written Opinion of the International Searching Authority, issued in PCT/NL2016/050415, dated Oct. 5, 2016.

* cited by examiner

DRILLING RIG WITH A TOP DRIVE SYSTEM OPERABLE IN A DRILLING MODE AND A TRIPPING MODE

CROSS REFERENCE TO RELATED APPLICATIONS

This application is a Divisional of U.S. application Ser. No. 15/737,068, filed on Dec. 15, 2017, which is the National Phase under 35 U.S.C. § 371 of International Application No. PCT/NL2016/050415, filed on Jun. 9, 2016, which claims priority under 35 U.S.C. § 119(a) to Application No. 2014988, filed in the Netherlands on Jun. 18, 2015, all of which are hereby expressly incorporated by reference into the present application.

The invention relates to the field of drilling rigs. For example the invention is applicable to mobile modular drilling rigs that are composed of modules that can be easily assembled and for example transported by road vehicles from one drilling location to the next.

Examples of modular mobile drilling rigs are presented in WO2006/038790, WO2013/133698, WO2013/109147, and WO2014/178712 of the present applicant.

The drilling rig comprises a drilling tower and a drill floor with a well center. The well center of the drill floor is in practice aligned with the wellbore or borehole, e.g. a wellbore to a hydrocarbon reservoir or for a geothermal well. In a land rig version the drill floor may be held at an elevated level above the ground, e.g. allowing for placement of a Blow Out Preventer underneath the drill floor. The rig may also be employed in an offshore environment, e.g. on a cantilever of a jack-up platform or on a jacket foundation, possibly with a subsea riser leading to the subsea wellbore or for use in a riserless wellbore operation.

In known embodiments a slip device is arranged at the well center and is adapted to suspend a drilling tubulars string in the wellbore. For example a remote controlled mechanized slip device is provided, allowing controlled operation thereof from an operator cabin.

In known embodiments the drilling rig comprises a tubulars connection makeup and breaking device near the well center, known in the art e.g. as an iron roughneck machine or mechanized tong device. Commonly such a device allows for mechanized connecting and disconnecting of threaded connectors at the ends of the drilling tubulars and/or of socket joints. For example a remote controlled mechanized tubulars connection makeup and breaking device is provided, allowing controlled operation thereof from an operator cabin.

In known embodiment the drilling rig comprises a fingerboard device that is adapted to store drilling tubulars stands.

In known embodiments the drilling rig comprises a top drive system and a vertical motion drive that is adapted to cause vertical motion of the top drive system relative to the drilling tower in order to perform drilling and tripping operations.

A known top drive system comprises a traveling carriage that is vertically mobile along one or more vertical rails of the drilling tower by means of the vertical motion drive. The one or more vertical rails are statically mounted and are parallel to a vertical firing line that extends through the well center.

The traveling carriage supports a top drive unit which comprises a top drive motor and a rotary torque output member, e.g. a rotary stem, that is adapted to be engaged, e.g. threaded, with a top end of a drilling tubulars string extending in the firing line through the well center to impart torque to said drilling tubulars string in order to perform drilling operations.

In the field a known operation is tripping of the drill string, e.g. when the drill bit has worn out and needs to be replaced or serviced. This involves tripping out, wherein the drill string is lifted so that a stand of multiple drilling tubulars extends above the drill floor. For example it is known to pull triple length stands, having a total length of about 90 ft. The drill string is then suspended in the wellbore by means of the slip device and the raised tubulars stand is disconnected by means of the tubulars connection makeup and breaking device near the well center. For example the connection makeup and breaking device is held by a mobile arm, e.g. the arm being mounted on a support on the drill floor remote from the well center. After breaking the connection, the tubulars stand is then placed in a slot of the fingerboard. This tripping out process is continued until the drill bit has reached the drill floor. After replacement or servicing of the drill bit, the drill string is tripped back into the borehole again. Other reasons for tripping a drill string are for example the need to service of replace other downhole tools, e.g. like a mud motor, a MWD unit (measurement while drilling), etc.

It is known to make use of a remote controlled mechanized tubulars racking device to move the tubulars stands between the firing line and the fingerboard, allowing controlled operation thereof from an operator cabin.

Tripping is commonly perceived as a time consuming and thereby expensive process. It is noted that tripping may also involve other tubular strings than the drill pipe string, e.g. a casing string composed of interconnected casing tubulars.

It is an object of a first aspect of the present invention to provide an improved drilling rig, e.g. in view of the desire to reduce time involved in a tripping operation.

According to a first aspect thereof the invention provides a drilling rig adapted to perform drilling and/or other wellbore related activities, the drilling rig comprising:

- a drilling tower,
- a drill floor with a well center positionable above a wellbore,
- a slip device arranged at the well center and adapted to suspend a drilling tubulars string in the wellbore,
- a tubulars connection makeup and breaking device near the well center,
- a top drive system,
- a vertical motion drive adapted to cause vertical motion of the top drive system relative to the drilling tower in order to perform drilling and tripping operations,
- a fingerboard device adapted to store drilling tubulars stands, wherein the drilling tower is provided with one or more vertical rails parallel to a vertical firing line that extends through the well center, wherein the top drive system comprises:

- a traveling carriage that is vertically mobile along said one or more vertical rails of the drilling tower by means of said vertical motion drive,
- a top drive unit supported by said traveling carriage and comprising a top drive motor and a rotary torque output member, e.g. a rotary stem, adapted to be engaged with a top end of a drilling tubulars string extending in a firing line through the well center to impart torque to said drilling tubulars string in order to perform drilling operations, wherein the top drive system further comprises a tripping operation elevator that is adapted to be engaged with a drilling tubulars string or drilling tubulars stand, e.g. with the top end thereof, in order to perform tripping operations, wherein the top drive unit and the tripping operation elevator are each mobile relative to the traveling carriage, and wherein the top drive system is provided with one or more actuators adapted to cause said relative motion of the top drive unit and of the tripping operation elevator so as to provide:

a drilling mode, and a tripping mode, wherein, in said drilling mode, the top drive unit is in operative position with the rotary torque output member being aligned with the firing line and wherein the tripping operation elevator is in a non-operative position remote from said firing line, and wherein, in said tripping mode, the tripping operation elevator is in operative position being aligned with the firing line and wherein the top drive unit is in a non-operative position, and wherein the top drive system is embodied such that, in said tripping mode, an unobstructed zone is present vertically above the tripping operation elevator allowing the top drive system to be lowered along a drilling tubulars stand in the firing line above the well center, at least so that the top drive system is below the top end thereof, e.g. allowing lowering till near the well center on the drill floor, whilst the drilling tubulars stand is disconnected by means of the tubulars connection makeup and breaking device, and wherein the top drive system is embodied such that, in said tripping mode and with the top drive system lowered at least below the top end of said drilling tubulars stand, said drilling tubulars stand is removable from the firing line, primarily in lateral direction, to allow for placement of said drilling tubulars stand in said fingerboard device.

The drilling rig according to the first aspect of the invention allows to combine the known and advantageous use of a top drive system for a drilling operation, instead of using a rotary table drive system to impart torque to the drill string, with a fast tripping of the drilling tubulars string and also with a fast and efficient switchover from a drilling operation to a tripping operation and vice versa.

In a preferred embodiment all equipment involved in the tripping process of this drilling rig is mechanized by provision of appropriate drive and control devices, and are preferably remote controlled from an operator cabin, allowing to perform the tripping operation without any crew members near the well center or at least with minimal human presence near the well center during the tripping.

Preferably all equipment involved in the tripping operation as discussed herein is connected to a central computerized control unit that is programmed to perform the tripping operation, at least of a major part of the drilling tubulars string, fully automated. It is envisaged that in such fully automated tripping sequence one or more operators in an operator cabin merely serve to supervise the process and respond in case of anomalies. In a semi-automated sequence some commands may be given via one or more input devices by the one or more operators, these commands starting parts of the sequence.

In an embodiment the tripping operation elevator comprises a C-shaped body in top view with a laterally open, e.g. to the front, vertical passage through the elevator body that is dimensioned to allow unhindered vertical passage of the elevator body along the drilling tubulars stand in the firing line when the carriage is moved during tripping, i.e. clearing any enlarged diameter portion(s) thereon formed by one or more connectors in the drilling tubulars stand. The dimensions of the vertical passage and open lateral side, e.g. front, may be chosen to the largest diameter of the drilling tubulars to be handled, thereby obviating the need to replace the tripping operation elevator when a different diameter tubular is to be handled, e.g. when handling casing instead of drill pipe joints.

The tripping operation elevator preferably further comprises one or more mobile, e.g. pivotal, locking or tubular engagement members, e.g. on opposite sides of the vertical passage through the elevator body, which in a clearance position thereof allow for passage of the enlarged diameter portion(s) in the tubulars stand during descent of the carriage in tripping and in a locked position thereof engage underneath a shoulder formed by such an enlarged diameter portion, e.g. connector, e.g. threaded connector, of the tubular in order to allow the tubular, more in particular the tubulars string, to be lifted.

For example two mobile locking members are provided on the tripping operation elevator, each pivotal about a horizontal axis, e.g. each having a tubular facing end with a semi-circular recess adapted to the diameter of the tubular to be handled. For example it is envisaged that the locking members are adapted to the diameter of tubular to be handled, and that only the locking members are exchanged if another tubular diameter is to be handled.

For example an actuator, e.g. a hydraulic cylinder, is provided for each locking member, e.g. allowing for remote control of the locking member. For example the tripping elevator is provided with a C-shaped horizontal cross section funnel at its lower end facilitating the sliding of the elevator along the tubulars stand as well as the passing of the elevator of the stick up end of a suspended tubulars string.

In an embodiment the top drive unit and the tripping operation elevator are mechanically linked so as to move in unison when operating the one or more actuators to switch between said drilling mode and said tripping mode. This allows for reduction of the number of actuators involved in the switchover and also avoids any opportunity for collision of the top drive unit and the tripping operation elevator, thereby increasing the freedom to design both parts of the top drive system.

In an embodiment the top drive unit is supported on the traveling carriage by a parallelogram mechanism with horizontal pivot axes. This mechanism comprises at least one pair of upper and lower support arms, e.g. one pair at the left-hand side and one pair at the right-hand side of the carriage, that are each pivotally connected to the carriage and to the top drive unit. Preferably the pivot axis on the carriage are in arranged along a vertical line is side view, preferably said line being encompassed in a plane through the firing line. The provision of a parallelogram mechanism allows to avoid the use of sliding supports for the top drive unit relative to the carriage and relies on pivots or hinges instead which have increased reliability in the harsh drilling rig environment.

In an embodiment the tripping operation elevator is suspended by one or more links or bails that are each connected at an upper end thereof from a pivotal elevator support arm that is pivotally connected to the traveling carriage about a horizontal pivot axis. This arrangement allows for a robust design of the mechanism that moves this elevator between its tripping mode and drilling mode positions relative to the carriage.

In an embodiment the carriage is provided with at least one integrated pivotal support arms member, that is pivotally mounted in the carriage about a horizontal pivot axis, and which integrated pivotal support arms member forms a support arm that support the top drive unit on the traveling carriage, e.g. in combination with a further support arm to form a parallelogram mechanism, and which integrated pivotal support arms member further forms a tripping elevator support arm from which the tripping operation elevator is suspended, e.g. by one or more links. For example the carriage is provided with a left-hand side integrated pivotal support arms member and a right-hand side pivotal support arms member, e.g. said members being connected to opposite sides of a top drive frame. For example, as preferred, the left-hand and right-hand side integrated pivotal support arms member each extend along the inner side of a respective side wall of a U-shaped horizontal cross-section mast so as to move the top drive unit between an operative position with the rotary output member aligned with the firing line and a retracted position in the tripping mode, wherein the top drive unit is closer to the rear wall of the mast. It will be appreciated that due to the direct mechanical link the tripping operation elevator will also move between the respective positions associated with the drilling mode and the tripping mode. In an embodiment an actuator is arranged to act on an integrated pivotal support arms member, e.g. mounted between the carriage frame and the integrated pivotal support arms member.

In an embodiment the top drive system further comprises a stabilizer rod for each link from which the tripping operation elevator may be suspended, e.g. from a pivotal support arm, said stabilizer rod having one end that is pivotally connected to the link and another end that is pivotally connected to the carriage frame, e.g. so as to form a parallelogram mechanism in combination with the pivotal elevator support arm, so as to prevent sway of the link in the drilling mode of the top drive system.

In an embodiment the vertical motion drive comprises a crown block assembly with sheaves, said crown block being mounted on the tower, and further comprises a drawworks with a winch and winch driven cable, wherein the traveling carriage is provided with sheaves, said traveling carriage being suspended from the crown block by said cable passing over said sheaves. In an alternative design the vertical motion drive may comprise one or more long stroke hydraulic cylinders, a rack-and-pinion motion drive, or otherwise.

In an embodiment the sheaves on the traveling carriage are assembled in a left-hand sheave assembly and a right-hand sheave assembly with the unobstructed zone passing between these sheave assemblies. Preferably a sheave axis of the sheaves on the carriage intersects or passes close to the firing line, so that—in the drilling mode—the rotary output member is vertically below this sheave axis. This allows to create as much as possible a vertical load path between the sheaves on the traveling carriage and the part of the top drive system that is in one of the mentioned modes present in the firing line.

For example when the tripping elevator is suspended from one or more links it is preferred for said one or more links to be in vertical orientation when in tripping mode, in vertical alignment with the sheaves on the carriage and of the crown block to create a vertical load path for tripping loads. It is noted that during tripping out the vertical loads may be very substantial, not only due to weight of the drilling tubulars string but also due to friction in the wellbore, wellbore curvature and narrow passages, etc. In a preferred embodiment the firing line is located between front posts of a U-shaped horizontal cross section mast, with the carriage travelling between rails fixed to said front posts, so that said vertical tripping loads are in a plane intersecting the front posts.

In an embodiment the top drive unit is supported on the traveling carriage by a parallelogram mechanism with horizontal pivot axes and—in the drilling mode—the pivot axes of the parallelogram mechanism joining the carriage are in a vertical plane, preferably in a vertical plane that encompasses the firing line.

In an embodiment the tripping operation elevator is suspended by one or more links that are each connected at an upper end thereof from a pivotal elevator support arm that is pivotally connected to the traveling carriage about a horizontal pivot axis and—in the tripping mode—the links of the tripping operation elevator are in a vertical plane. Preferably in an embodiment this vertical plane extends through, or is close to, a plane through the sheaves of the crown block and the sheaves on the traveling carriage in order to create as much as possible a vertical load path.

In an embodiment the top drive unit comprises a top drive frame supporting the top drive motor and the rotary output member, possibly with an intermediate gear arrangement, possibly with other top drive associated elements, e.g. like a grabber, mud saver valve, etc. The frame is mobile mounted to the carriage, e.g. by means of a parallelogram mechanism, causing the frame to be displaceable between a non-operative position and a position wherein the rotary output member is aligned with the firing line. In an embodiment of the mast as a U-shaped horizontal cross section mast, it is envisaged in an embodiment that the top drive frame is close to the rear wall when in the non-operative position and in a more forward position when in drilling mode, so that the rotary output member is aligned with the firing line, e.g. said firing line being located in a plane through vertical front posts of the mast.

In an embodiment with the mast as a U-shaped horizontal cross section mast and with the top drive frame being mobile mounted to the carriage, e.g. by means of a parallelogram mechanism, it may be desirable to embody the carriage and top drive frame and top drive unit such that, in non-operative position the entirety of the carriage, top drive frame and top drive unit is located within the contour of the mast, so not protruding from the open front end of the mast. For example this may allow for shipment of a mast section, e.g. in lying horizontally on a flatbed trailer, with the carriage, top drive frame, and top drive unit with the frame in non-operative position. It will be appreciated that this may be advantageous even in an embodiment wherein there is no tripping operation elevator as discussed herein, e.g. just a regular top drive mounted elevator.

In an embodiment the top drive frame is connected to the carriage by a parallelogram mechanism and the one or more actuators are mounted between the traveling carriage and the top drive frame or between the carriage and arms or hinges of the parallelogram mechanism.

In an embodiment the tower is a mast having a U-shaped horizontal cross section with a left-hand mast wall, a rear mast wall, and a right-hand mast wall, and with an open front. For example the mast is composed of connectable mast sections, e.g. including a crown section provided with a crown block, a lower or floor section to be connected to the drill floor, and with one or more intermediate sections.

In an embodiment the mast comprises left-hand and right-hand vertical front posts and rear corner posts, with each front post being connected by bracings to a respective rear corner post to form the respective side wall of the mast and said rear corner posts being connected to each other by bracings to form the respective rear wall of the mast, with the mast having an open front side between the front posts.

In an embodiment a vertical rails is fixed to each of the front posts and the traveling carriage is guided along said vertical rails, so that the carriage travels between these rails, e.g. with the top drive unit mainly within the contour of the U-shaped cross section mast, at least in the tripping mode.

In an embodiment the carriage travels between two vertical rails that extend in a vertical plane that encompasses the firing line, e.g. said rails being fixed to vertical front posts of a U-shaped horizontal cross section mast.

In an embodiment the carriage comprises a structural frame with a left-hand carriage frame member and a right-hand carriage frame member interconnected by one or more transverse frame members, wherein said transverse frame members extend rearward of the firing line to provide the mentioned unobstructed zone allowing the lateral removal of the tubulars stand in forward direction.

In an embodiment a left-hand sheave assembly is mounted on the left-hand carriage frame member and a right-hand sheave assembly on the right-hand carriage frame member with said unobstructed zone passing between these sheave assemblies.

In an embodiment the carriage has left-hand and right-hand carriage frame members that are each provided with one or more rail followers, e.g. rollers and/or glide bearings, that engage on two vertical guide rails between which the carriage travels.

In an embodiment the top drive system further comprises a drilling operation elevator, distinct from the tripping operation elevator, which drilling operation elevator is adapted to retain a drilling tubular in vertical orientation below the rotary output member of the top drive unit. The drilling elevator is commonly used in the field, e.g. for use in stand building and other activities. In an embodiment the drilling elevator comprises an annular elevator body that can be opened to allow introduction of a tubular in the elevator and then closed to form a closed annular body around the tubular, e.g. an actuator being provided for remote controlled opening and closing of the drilling elevator body. As is known in the field the closed annular elevator body may engage underneath a shoulder formed by an enlarged diameter portion of a tubular, e.g. a connector, e.g. a threaded connector at the end of the tubular.

In an embodiment, as is known in the field the drilling operation elevator is suspended from the top drive unit. For example the drilling operation elevator is suspended by means of a pair of links or bails that are pivotally connected at their upper ends to the top drive unit. In an embodiment a tilt mechanism is provided that engages on the links or bails of the drilling operation elevator and adapted to move the links between tilted orientations and a vertical orientation.

In an embodiment a left-hand fingerboard device is mounted to the left-hand side of the mast and a right-hand side fingerboard device is mounted to the right-hand side of the mast. Placing these fingerboards to the sides of the mast is advantageous, e.g. in view of a line of vision from an operator cabin onto the front side of the mast where the top drive system travels. As preferred in this arrangement the mast is a U-shaped horizontal cross-section mast with left-hand and right-hand side walls, a rear wall, and an open front, e.g. having one or more features as discussed herein. Preferably each of these fingerboard devices has fingers defining slots that extend parallel to the respective side of the mast and are open at the front side of the fingerboard device. So the stands are effectively stored to the left and the right of the mast, and do not hinder the view onto the front side of the mast.

In an embodiment the drilling rig comprises a tubulars racking device comprising one or more mobile tubulars gripper assemblies with one or more grippers adapted to grip a tubular or tubulars stand and move the tubular or tubulars stand between each fingerboard device and the firing line. As mentioned it is known and preferred for said tubulars racking device to be mechanized and to allow for remote control thereof, e.g. from an operator cabin, e.g. allowing for fully or semi-automatic operation based on a suitably programmed computerized control unit, e.g. as part of a fully or semi-automatic control of a tripping process.

In an embodiment a left-hand fingerboard device is mounted to the left-hand side of the mast and a right-hand side fingerboard device is mounted to the right-hand side of the mast with slots for the stands at the front side of each fingerboard device. A tubulars racking device comprises a structural frame supported by the mast, at an elevated position thereon relative to the drill floor, wherein said structural frame comprises one or more horizontal rails extending across the open front side of the mast and across the front sides of the fingerboard devices. The tubulars racking device further comprises a mobile tubulars gripper assembly guided by said one or more rails and provided with one or more grippers and adapted to grip a tubular stand and move the tubulars stand between the fingerboard devices and the firing line. The tubulars racking device is embodied to allow for vertical passage of the top drive system in its drilling mode as well as in its tripping mode, e.g. with the tripping operation elevator being brought in a position forward of the mast when in drilling mode. Preferably the mobile tubulars gripper assembly is movable both in X direction (along the mentioned one or more rails of the structural frame) and in Y direction (in forward and rearward direction perpendicular to said rail or rails) in a horizontal plane.

In an embodiment the structural frame of the racking device comprises a roof that extends over the rails so as to shield them, e.g. with one rails being an overhead rails extending underneath the roof.

In an embodiment a mobile tubulars gripper assembly of the tubulars racking device is provided with an auxiliary winch and a winch driven cable, preferably the assembly being movable both in X and Y directions in a horizontal plane, wherein the mobile tubulars gripper assembly is positionable at least in a position such that the winch driven cable is aligned above the well center and can be lowered to the well center on the drill floor to perform lifting operations above or near the well center using the auxiliary winch on the mobile tubulars gripper assembly of the tubulars racking device. This basically allows for the use of the tubulars racking device as a crane for lifting objects that have to be placed at the well center or removed from the well center. For example this crane may be employed to handle an RCD device for managed pressure drilling operations, the tripping operation elevator when replacement is needed, the slip device, etc.

In an embodiment the tower, e.g. a U-shaped horizontal cross section mast, is provided at the top thereof with an auxiliary crane having a base secured to the tower and a crane boom connected via a vertical axis slew bearing to the base allowing to slew the boom, e.g. about a full revolution, wherein the auxiliary crane comprises a winch and a winch driven cable for hoisting of objects, wherein the auxiliary crane is embodied such that the winch driven cable can be passed vertically along the firing line down to the well center in the tripping mode of the top drive system so as to allow for use of the auxiliary crane for lifting operations at or near, or towards and away from, the well center.

In an embodiment the auxiliary crane at the top of the mast is a jib or cantilever crane, wherein the boom extends permanent in horizontal direction and wherein a trolley is displaceable along the boom, with the trolley being provided with a sheave and/or the winch, and the trolley is at least positionable so that the winch driven cable passing over said sheave and/or depending from the winch is aligned with the firing line, and a position remote from said firing line position.

The first aspect of the invention also relates to a drilling rig comprising:

a drilling mast having a U-shaped horizontal cross section with a left-hand mast wall, a rear mast wall, and a right-hand mast wall, and with an open front side, e.g. said mast being composed of interconnected mast sections, a drill floor with a well center, a top drive system, a vertical motion drive adapted to cause vertical motion of the top drive system relative to the drilling mast in order to perform drilling and tripping operations, a fingerboard device adapted to store drilling tubulars stands in vertical orientation, wherein the mast, e.g. the left-hand and right-hand walls of the mast, is provided with one or more vertical rails parallel to a vertical firing line that extends through the well center, wherein the top drive system comprises:

a traveling carriage that is vertically mobile along said one or more vertical rails of the drilling mast by means of said vertical motion drive, a top drive unit supported by said carriage and comprising a top drive motor and a rotary torque output member, e.g. a rotary stem, adapted to be engageable with a top end of a drilling tubulars string extending in the firing line through the well center to impart torque to said drilling tubulars string in order to perform drilling operations, wherein the top drive system further comprises a tripping operation elevator that adapted to be engageable with a drilling tubulars string or drilling tubulars stand, e.g. with the top end thereof, in order to perform tripping operations, wherein the top drive unit and the tripping operation elevator are each mobile relative to the traveling carriage, and wherein the top drive system is provided with one or more actuators adapted to cause said relative motion of the top drive unit and of the tripping operation elevator so as to provide:

a drilling mode, and a tripping mode, wherein in said drilling mode the top drive unit is in operative position with the rotary torque output member being aligned with the firing line and wherein the tripping operation elevator is in a non-operative position forward from said firing line, and wherein in said tripping mode the tripping operation elevator is in operative position being aligned with the firing line and wherein the top drive unit is in a non-operative position further towards the rear wall of the mast, and wherein the top drive system is embodied such that—in said tripping mode—an unobstructed zone is present vertically above the tripping operation elevator allowing the top drive system to be lowered along a drilling tubulars stand in the firing line above the drill floor, at least so that the top drive system is below the top end thereof, e.g. allowing lowering till near the drill floor, and wherein the top drive system is embodied such that—in said tripping mode and with the top drive system lowered at least below the top end of said drilling tubulars stand—said drilling tubulars stand is removable from the firing line, primarily in lateral and forward direction, to place said drilling tubulars stand in said fingerboard device.

It will be appreciated that the above defined drilling rig may have any of the further technical features or details, alone or in combination, as discussed herein.

For example the mast may comprise left-hand and right-hand front posts of the left-hand and right-hand side wall respectively, wherein said vertical rails are mounted on said front posts.

The first aspect of the invention also relates to:

In combination a drilling mast and a top drive system for a drilling rig having a drill floor with a well center, wherein the drilling mast has a U-shaped horizontal cross section with a left-hand mast wall, a rear mast wall, and a right-hand mast wall, and with an open front side, e.g. said mast being composed of interconnected mast sections, wherein the mast, e.g. the left-hand and right-hand walls of the mast, is provided with one or more vertical rails that are—in use of the drilling rig—parallel to a vertical firing line that extends through the well center, wherein the top drive system comprises:

a traveling carriage that is vertically mobile along said one or more vertical rails of the drilling mast by means of a vertical motion drive, a top drive unit supported by said carriage and comprising a top drive motor and a rotary torque output member, e.g. a rotary stem, adapted to be engageable with a top end of a drilling tubulars string extending in the firing line through the well center to impart torque to said drilling tubulars string in order to perform drilling operations, wherein the top drive system further comprises a tripping operation elevator that adapted to be engageable with a drilling tubulars string or drilling tubulars stand, e.g. with the top end thereof, in order to perform tripping operations, wherein the top drive unit and the tripping operation elevator are each mobile relative to the traveling carriage, and wherein the top drive system is provided with one or more actuators adapted to cause said relative motion of the top drive unit and of the tripping operation elevator so as to provide:

a drilling mode, and a tripping mode, wherein in said drilling mode the top drive unit is in operative position with the rotary torque output member being aligned with the firing line and wherein the tripping operation elevator is in a non-operative position forward from said firing line, and wherein in said tripping mode the tripping operation elevator is in operative position being aligned with the firing line and wherein the top drive unit is in a non-operative position further towards the rear wall of the mast, and wherein the top drive system is embodied such that—in said tripping mode—an unobstructed zone is present vertically above the tripping operation elevator allowing the top drive system to be lowered along a drilling tubulars stand in the firing line above the drill floor, at least so that the top drive system is below the top end thereof, e.g. allowing lowering till near the drill floor, and wherein the top drive system is embodied such that—in said tripping mode and with the top drive system lowered at least below the top end of said drilling tubulars stand—said drilling tubulars stand is removable from the firing line, primarily in lateral and forward direction, to place said drilling tubulars stand in a fingerboard device of the drilling rig.

It will be appreciated that the above defined combination of drilling mast and top drive system for a drilling rig may have any of the further technical features or details, alone or in combination, as discussed herein.

The first aspect of the invention also relates to a top drive system for use in a drilling rig having a mast with a U-shaped horizontal cross section with a left-hand mast wall, a rear mast wall, and a right-hand mast wall, and with an open front side, e.g. said mast being composed of interconnected mast sections, wherein the mast, e.g. the left-hand and right-hand walls of the mast, is provided with one or more vertical rails that are—in use of the drilling rig—parallel to a vertical firing line that extends through the well center, wherein the top drive system comprises:

a traveling carriage that is adapted to be vertically mobile along said one or more vertical rails of the drilling mast by means of a vertical motion drive, a top drive unit supported by said carriage and comprising a top drive motor and a rotary torque output member, e.g. a rotary stem, adapted to be engageable with a top end of a drilling tubulars string extending in the firing line through the well center to impart torque to said drilling tubulars string in order to perform drilling operations, wherein the top drive system further comprises a tripping operation elevator that adapted to be engageable with a drilling tubulars string or drilling tubulars stand, e.g. with the top end thereof, in order to perform tripping operations, wherein the top drive unit and the tripping operation elevator are each mobile relative to the traveling carriage, and wherein the top drive system is provided with one or more actuators adapted to cause said relative motion of the top drive unit and of the tripping operation elevator so as to provide:

a drilling mode, and a tripping mode, wherein in said drilling mode the top drive unit is in operative position with the rotary torque output member being aligned with the firing line and wherein the tripping operation elevator is in a non-operative position forward from said firing line, and wherein in said tripping mode the tripping operation elevator is in operative position being aligned with the firing line and wherein the top drive unit is in a non-operative position further towards the rear wall of the mast, and wherein the top drive system is embodied such that—in said tripping mode—an unobstructed zone is present vertically above the tripping operation elevator allowing the top drive system to be lowered along a drilling tubulars stand in the firing line above the drill floor, at least so that the top drive system is below the top end thereof, e.g. allowing lowering till near the drill floor, and wherein the top drive system is embodied such that—in said tripping mode and with the top drive system lowered at least below the top end of said drilling tubulars stand—said drilling tubulars stand is removable from the firing line, primarily in lateral and forward direction, e.g. to place said drilling tubulars stand in a fingerboard device of the drilling rig.

The first aspect of the invention also relates to a top drive system for use in a drilling rig having a mast, e.g. said mast being composed of interconnected mast sections, wherein the mast is provided with one or more vertical rails that are—in use of the drilling rig—parallel to a vertical firing line that extends through a well center, wherein the top drive system comprises:

a traveling carriage that is adapted to be vertically mobile along said one or more vertical rails of the drilling mast by means of a vertical motion drive, a top drive unit supported by said traveling carriage and comprising a top drive motor and a rotary torque output member, e.g. a rotary stem, adapted to be engageable with a top end of a drilling tubulars string extending in the firing line through the well center to impart torque to a drilling tubulars string in order to perform drilling operations, wherein the top drive system further comprises a tripping operation elevator that adapted to be engageable with a drilling tubulars string or drilling tubulars stand, e.g. with the top end thereof, in order to perform tripping operations, wherein the top drive unit and the tripping operation elevator are each mobile relative to the traveling carriage, and wherein the top drive system is provided with one or more actuators adapted to cause said relative motion of the top drive unit and of the tripping operation elevator so as to provide:

a drilling mode, and a tripping mode, wherein in said drilling mode the top drive unit is in operative position with the rotary torque output member being aligned with the firing line and wherein the tripping operation elevator is in a non-operative position forward from said firing line, and wherein in said tripping mode the tripping operation elevator is in operative position being aligned with the firing line and wherein the top drive unit is in a non-operative position, and wherein the top drive system is embodied such that—in said tripping mode—an unobstructed zone is present vertically above the tripping operation elevator allowing the top drive system to be lowered along a drilling tubulars stand in the firing line above the drill floor, at least so that the top drive system is below the top end thereof, e.g. allowing lowering till near a drill floor, and wherein the top drive system is embodied such that—in said tripping mode and with the top drive system lowered at least below the top end of said drilling tubulars stand—said drilling tubulars stand is removable from the firing line, e.g. to place said drilling tubulars stand in a fingerboard device of the drilling rig.

It will be appreciated that the above defined top drive system for a drilling rig may have any of the further technical features or details, alone or in combination, as discussed herein.

A second aspect of the invention relates to:

In combination a drilling mast and a top drive system for a drilling rig having a drill floor with a well center, wherein the drilling mast has a U-shaped horizontal cross section with a left-hand mast wall, a rear mast wall, and a right-hand mast wall, and with an open front side, e.g. said mast being composed of interconnected mast sections, wherein the mast, e.g. the left-hand and right-hand walls of the mast, is provided with one or more vertical rails that are—in use of the drilling rig—parallel to a vertical firing line that extends through the well center, wherein the top drive system comprises:

a traveling carriage that is vertically mobile along said vertical rails of the drilling mast by means of a vertical motion drive, a top drive unit supported by said carriage and comprising a top drive motor and a rotary torque output member, e.g. a rotary stem, adapted to be engageable with a top end of a drilling tubulars string extending in the firing line through the well center to impart torque to said drilling tubulars string in order to perform drilling operations, wherein a left-hand fingerboard device is mounted to the left-hand side of the mast and a right-hand side fingerboard device is mounted to the right-hand side of the mast, wherein each fingerboard device has fingers defining slots that preferably extend parallel to the respective side of the mast and are open at the front side of the fingerboard device.

As discussed this arrangement of the fingerboard devices allows for an enhanced view on the front side of the mast, e.g. from an operator cabin.

In an embodiment the combination of the second aspect of the invention further comprises a tubular stands racking device, wherein the racking device comprises a structural frame supported by the mast at an elevated position thereon relative to the drill floor, wherein said structural frame comprises one or more horizontal rail extending across the front side of the mast and across the front sides of the fingerboard devices, said racking device further comprising a mobile tubulars gripper assembly guided by said one or more rails and provided with one or more grippers and adapted to grip a tubular stand and move the tubulars stand between the fingerboard devices and the firing line.

In an embodiment the mast is provided with one or more cantilevers at a height above the structural frame of the racking device, wherein one or more suspension cables or rods extend from the one or more cantilevers to the structural frame so as to provided vertical support for the structural frame.

In an embodiment the structural frame of the racking device includes a roof.

It will be appreciated that the above combination according to the second aspect of the invention may have any of the further technical features or details, alone or in combination, as discussed herein.

The second aspect of the invention also relates to:

A drilling mast for a drilling rig having a drill floor with a well center, wherein the drilling mast has a U-shaped horizontal cross section with a left-hand mast wall, a rear mast wall, and a right-hand mast wall, and with an open front side, e.g. said mast being composed of interconnected mast sections, wherein a left-hand fingerboard device is mounted to the left-hand side of the mast and a right-hand side fingerboard device is mounted to the right-hand side of the mast, wherein each fingerboard devices has fingers defining slots that extend parallel to the respective side of the mast and are open at the front side of the fingerboard device.

In an embodiment the mast is provided with a tubular stands racking device comprising a structural frame that is supported by the mast at an elevated position thereon, wherein said structural frame comprises one or more horizontal rail extending across the front side of the mast and across the front sides of the fingerboard devices, said racking device further comprising a mobile tubulars gripper assembly guided by said one or more rails and provided with one or more grippers and adapted to grip a tubular stand and move the tubulars stand between the fingerboard devices and the firing line.

It will be appreciated that the drilling mast above according to the second aspect of the invention may have any of the further technical features or details, alone or in combination, as discussed herein.

A third aspect of the invention relates to:

A drilling mast for a drilling rig having a drill floor with a well center, wherein the drilling mast has a U-shaped horizontal cross section with a left-hand mast wall, a rear mast wall, and a right-hand mast wall, and with an open front side, e.g. said mast being composed of interconnected mast sections, wherein the mast is provided with at least one fingerboard device, e.g. a left-hand fingerboard device is mounted to the left-hand side of the mast and a right-hand side fingerboard device is mounted to the right-hand side of the mast, wherein each fingerboard devices has fingers defining slots, wherein the mast is provided with a racking device comprises a structural frame supported by the mast at an elevated position thereon, wherein said structural frame comprises one or more horizontal rails, said racking device further comprising a mobile tubulars gripper assembly guided by said one or more rails and provided with one or more grippers and adapted to grip a tubulars stand and move the tubulars stand between the fingerboard device and the firing line, wherein the mast is provided with one or more cantilevers at a height above the structural frame of the racking device, and wherein one or more suspension cables or rods extend from the one or more cantilevers to the structural frame so as to provided vertical support for the structural frame.

It will be appreciated that the drilling mast above according to the third aspect of the invention may have any of the further technical features or details, alone or in combination, as discussed herein.

A fourth aspect of the invention relates to:

A drilling tower for a drilling rig having a drill floor with a well center, possibly the drilling tower being a mast having a U-shaped horizontal cross section with a left-hand mast wall, a rear mast wall, and a right-hand mast wall, and with an open front side, e.g. said mast being composed of interconnected mast sections, wherein the tower is provided with at least one fingerboard device, e.g. a left-hand fingerboard device is mounted to the left-hand side of the mast and a right-hand side fingerboard device is mounted to the right-hand side of the mast, wherein each fingerboard devices has fingers defining slots, wherein the drilling tower is provided with a racking device comprises a structural frame supported by the tower at an elevated position thereon relative to the drill floor, wherein said structural frame comprises one or more horizontal rails, said racking device further comprising a mobile tubulars gripper assembly guided by said one or more rails and provided with one or more grippers and adapted to grip a tubular or tubulars stand and move the tubular or tubulars stand between the fingerboard device and the firing line through the well center, wherein the racking device is provided with an auxiliary winch having a winch driven cable, possibly with a hook, which auxiliary winch is embodied so that the winch driven cable or hook is alignable with the firing line through the well center and can be lowered to the well center on the drill floor in order to perform lifting operations above or near the well center using the racking device auxiliary winch.

It will be appreciated that the drilling tower above according to the fourth aspect of the invention may have any of the further technical features or details, alone or in combination, as discussed herein.

The fourth aspect of the invention also relates to:

A racking device comprises a structural frame to be supported by a drilling tower at an elevated position thereon relative to a drill floor, wherein said structural frame comprises one or more horizontal rails, said racking device further comprising a mobile tubulars gripper assembly guided by said one or more rails and provided with one or more grippers and adapted to grip a tubular or tubulars stand and move the tubular or tubulars stand between the fingerboard device and the firing line through the well center, wherein the racking device is provided with an auxiliary winch having a winch driven cable, possibly with a hook, which auxiliary winch is embodied so that the winch driven cable or hook is alignable with a firing line through a well center and can be lowered to the well center on the drill floor in order to perform lifting operations above or near the well center using the racking device auxiliary winch.

It will be appreciated that the racking device above according to the fourth aspect of the invention may have any of the further technical features or details, alone or in combination, as discussed herein.

The fourth aspect of the invention also relates to a method for hoisting an object to be placed at or removed from a well center of a drill floor of a drilling rig, wherein use is made of a drilling rig or racking device as described herein.

The present invention also relates to a drilling rig, mast, top drive system, carriage, racking device, or combinations thereof as disclosed herein, e.g. as shown in the drawings.

The present invention also relates to a method for drilling with a drill string and/or tripping a drill string wherein use is made of a drilling rig, mast, top drive system, carriage, racking device, or combinations thereof as disclosed herein, e.g. as shown in the drawings. For example the method involves the step of switching between drilling and tripping.

The invention and various aspects and optional details thereof will now be explained with reference to the drawings. In the drawings.

Figure 1:
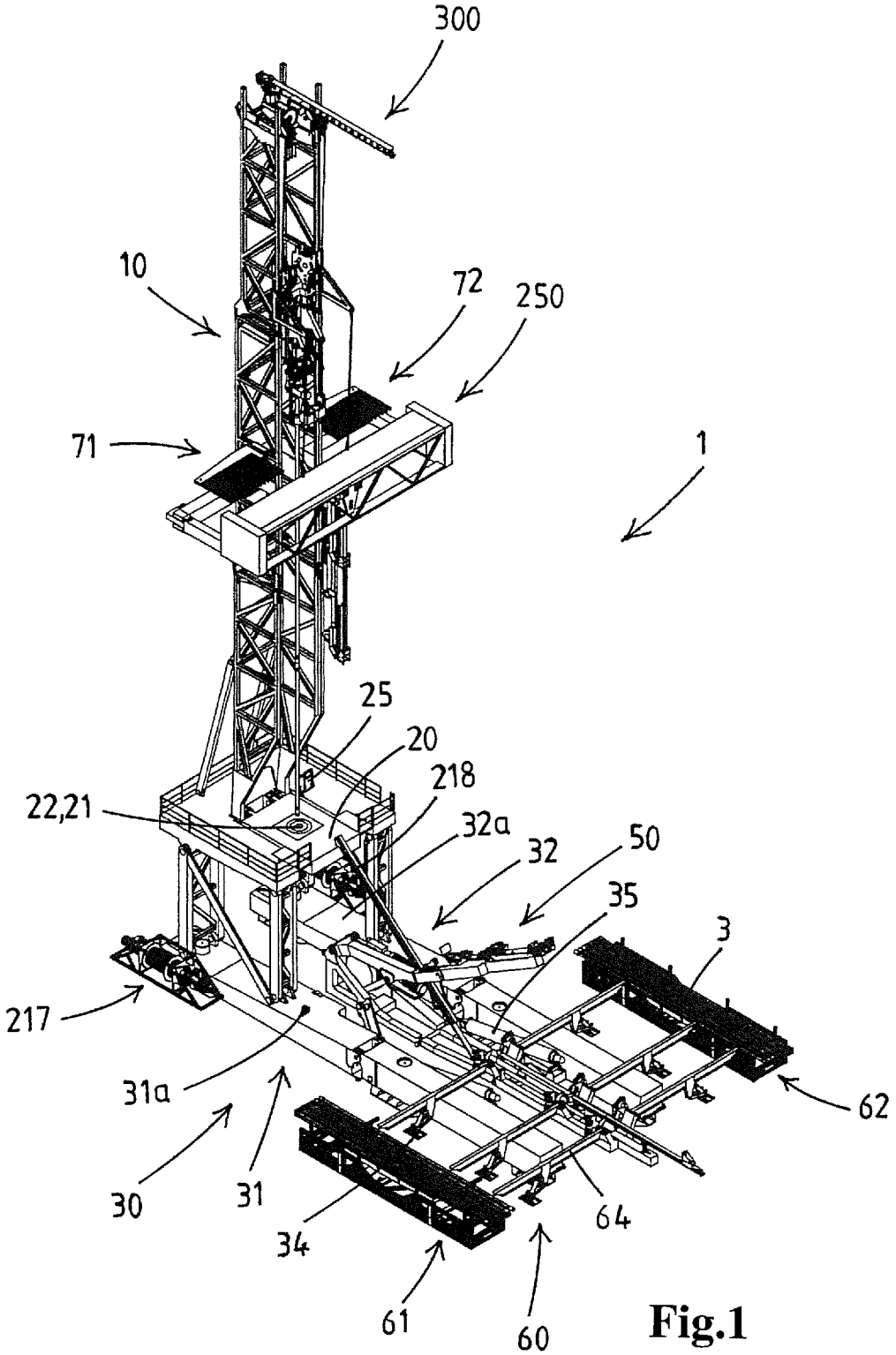
FIG. 1 shows in perspective view a drilling rig according to the invention.
Figure 2:
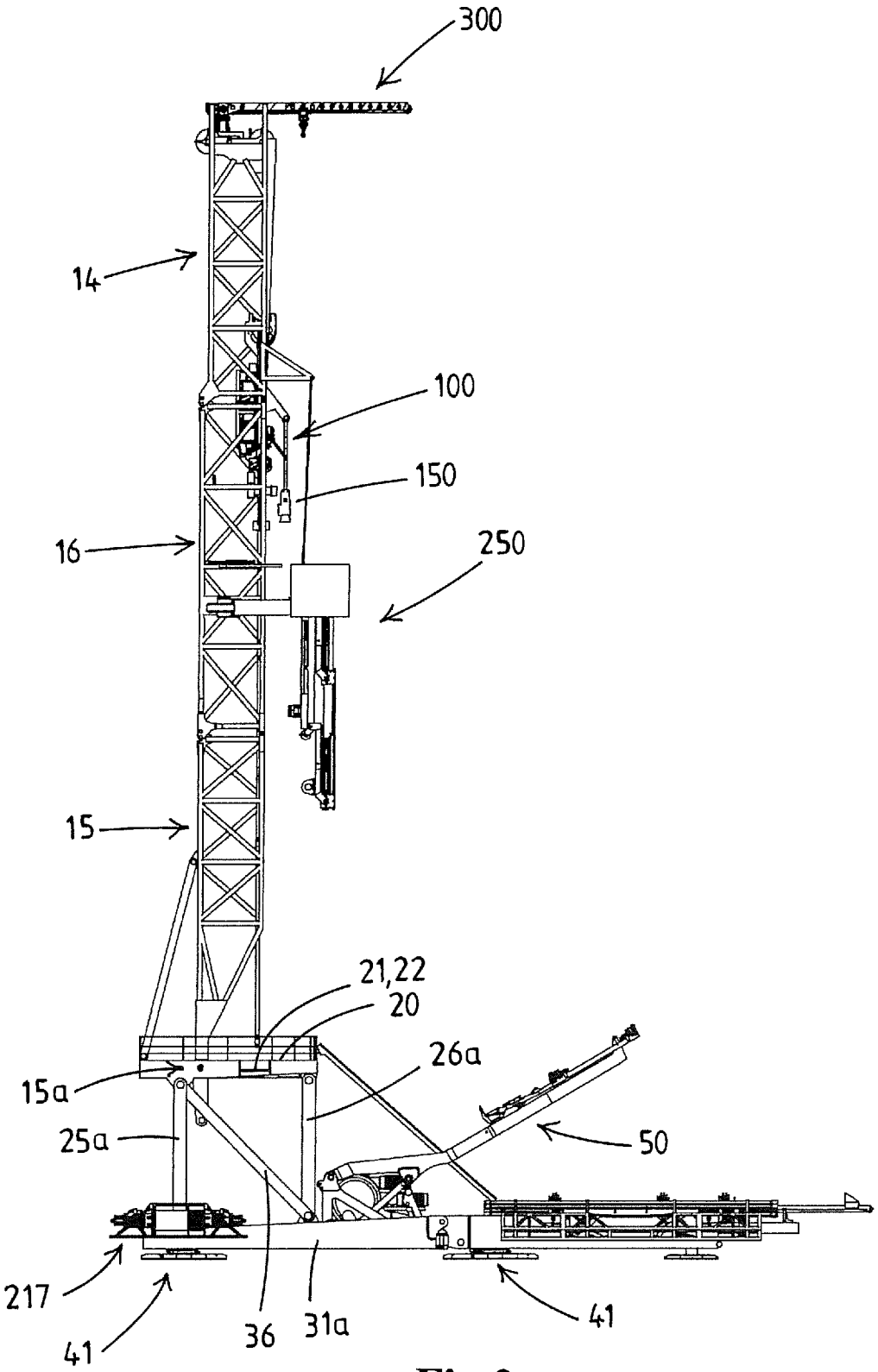
FIG. 2 shows the rig of FIG. 1 in side view.
Figure 3:
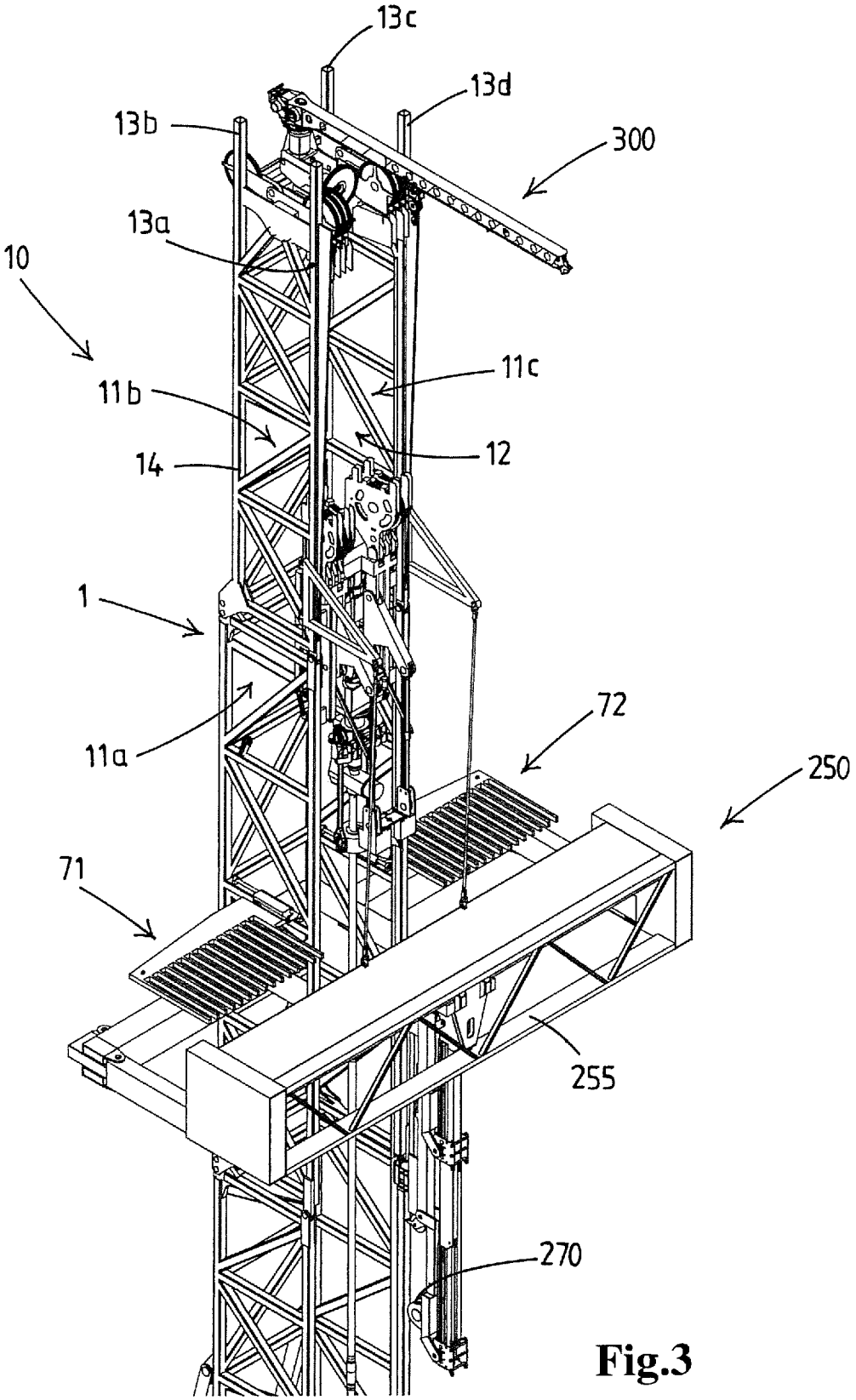
Figure 4:
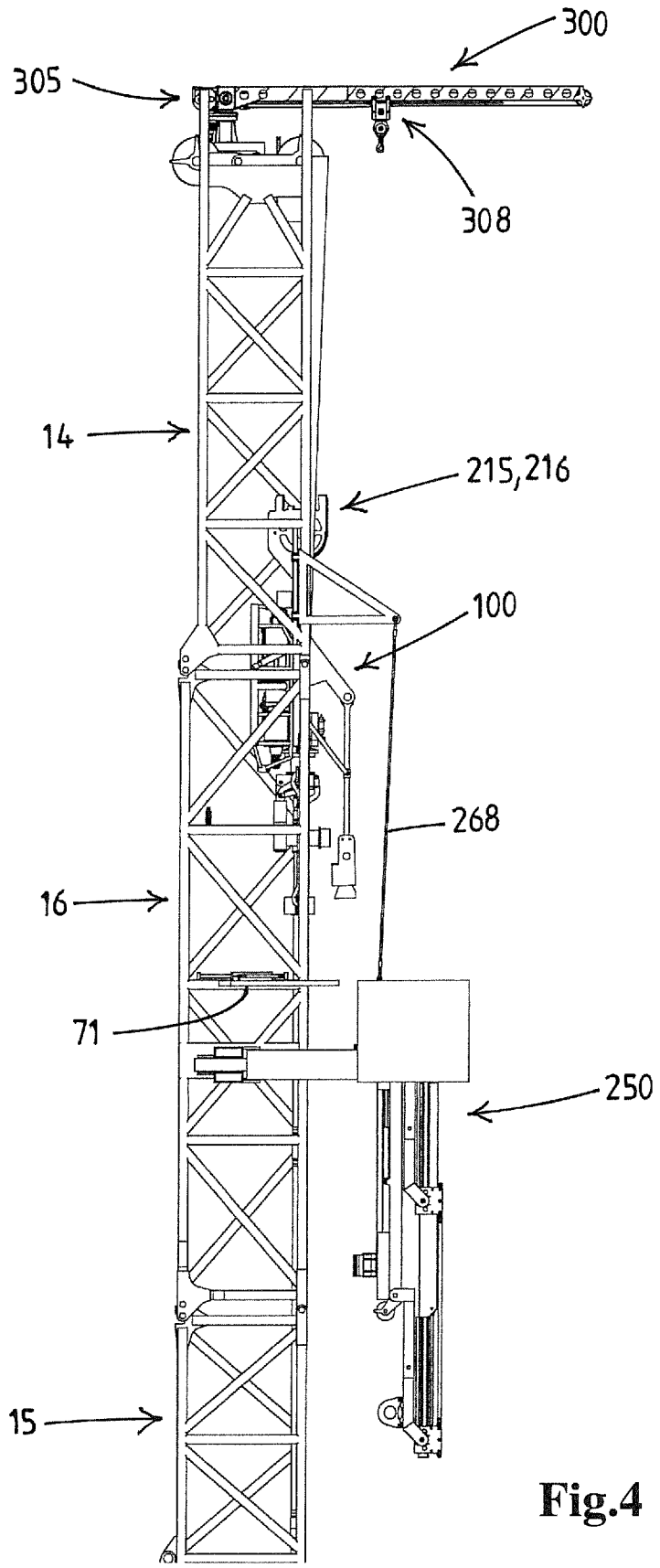
Figure 5A:
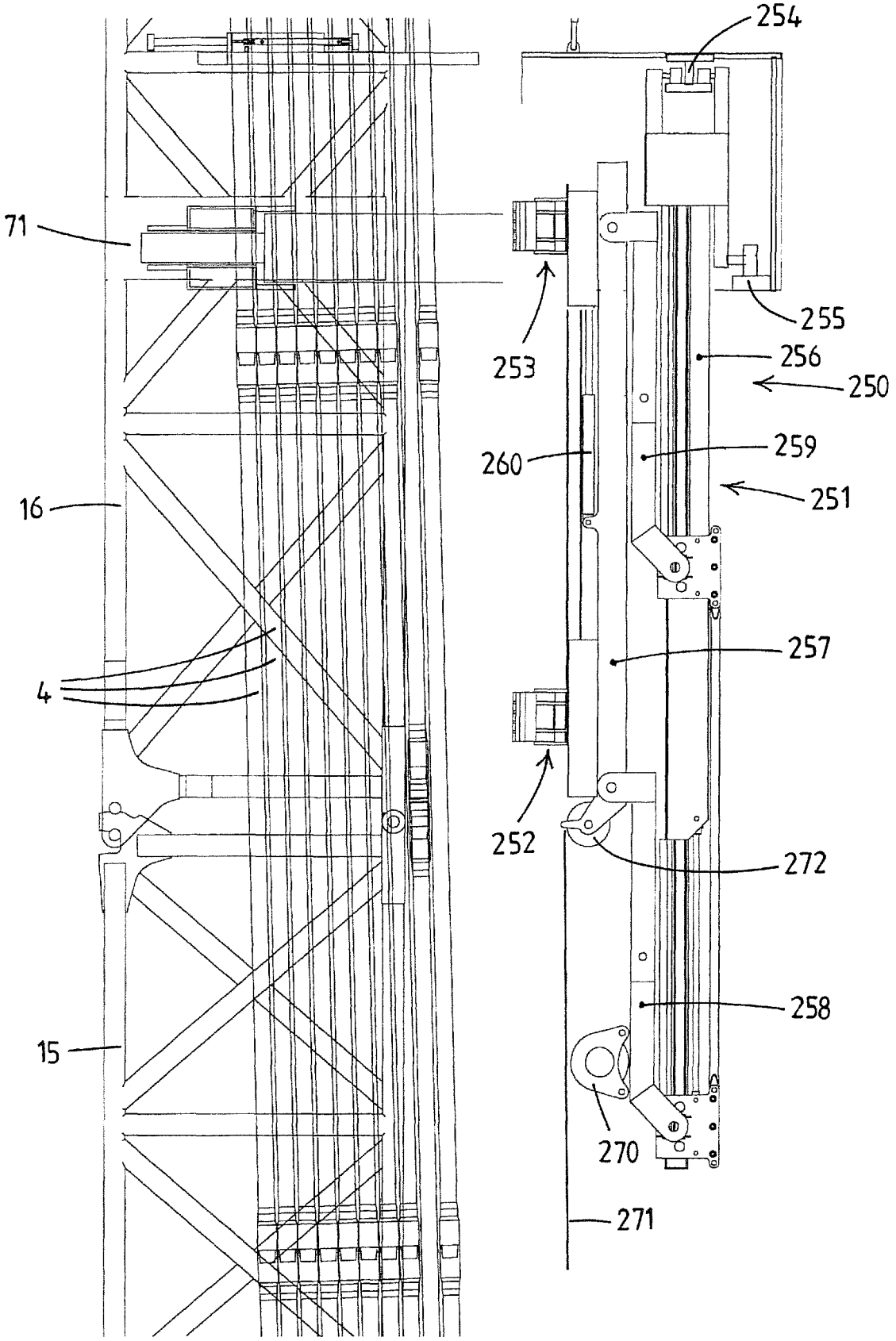
Figure 5B:
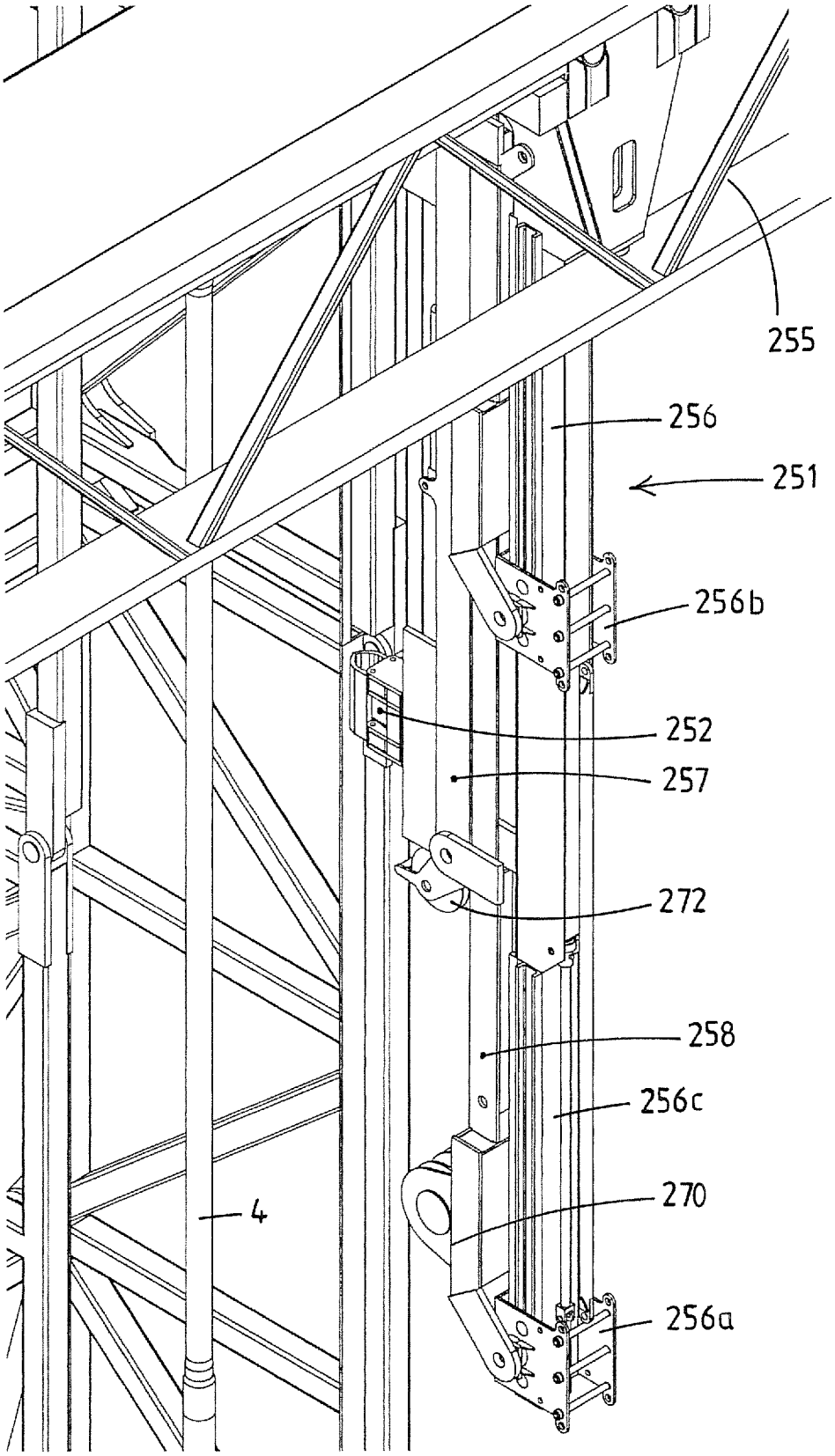
Figure 6:
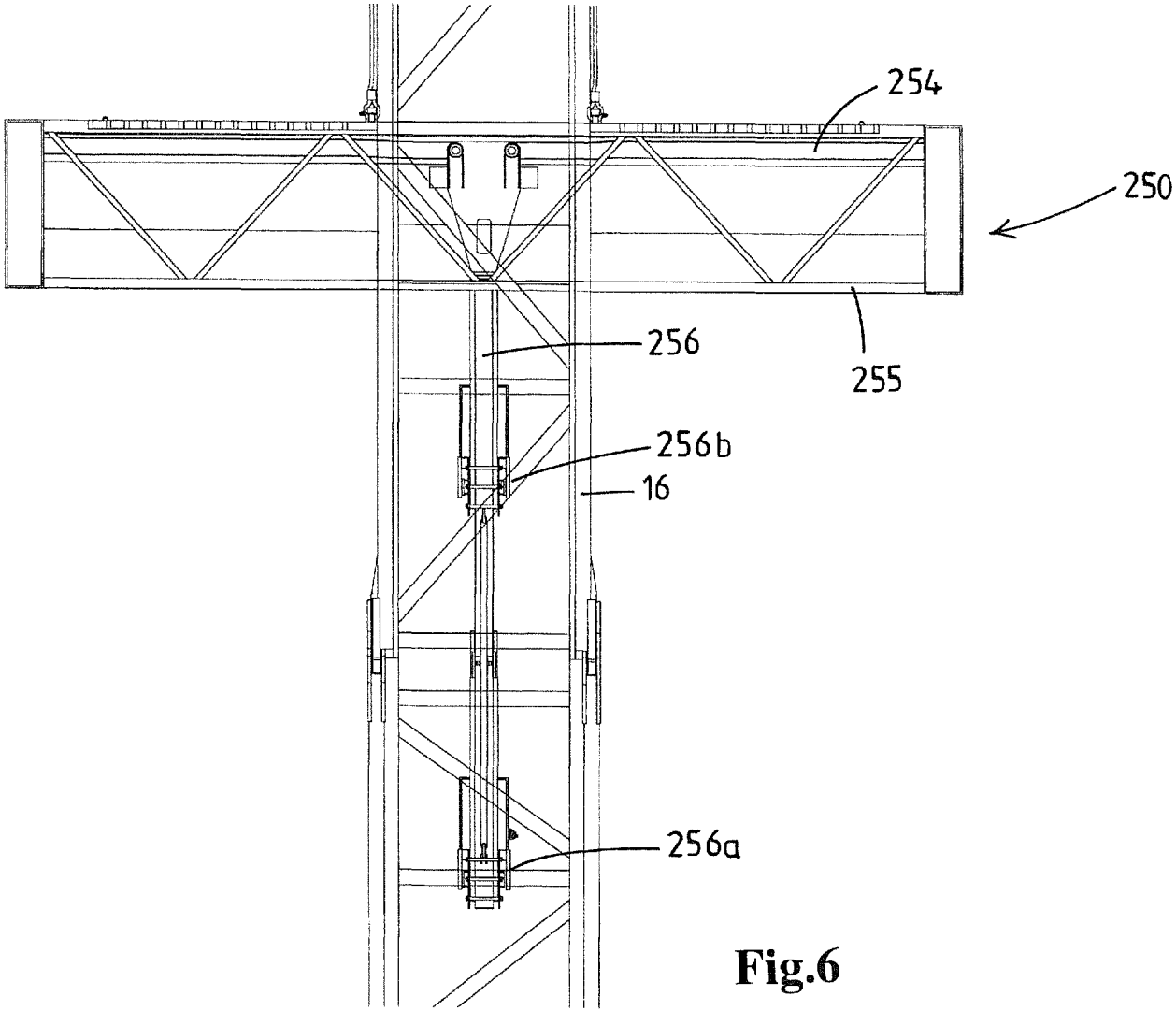
Figure 7:
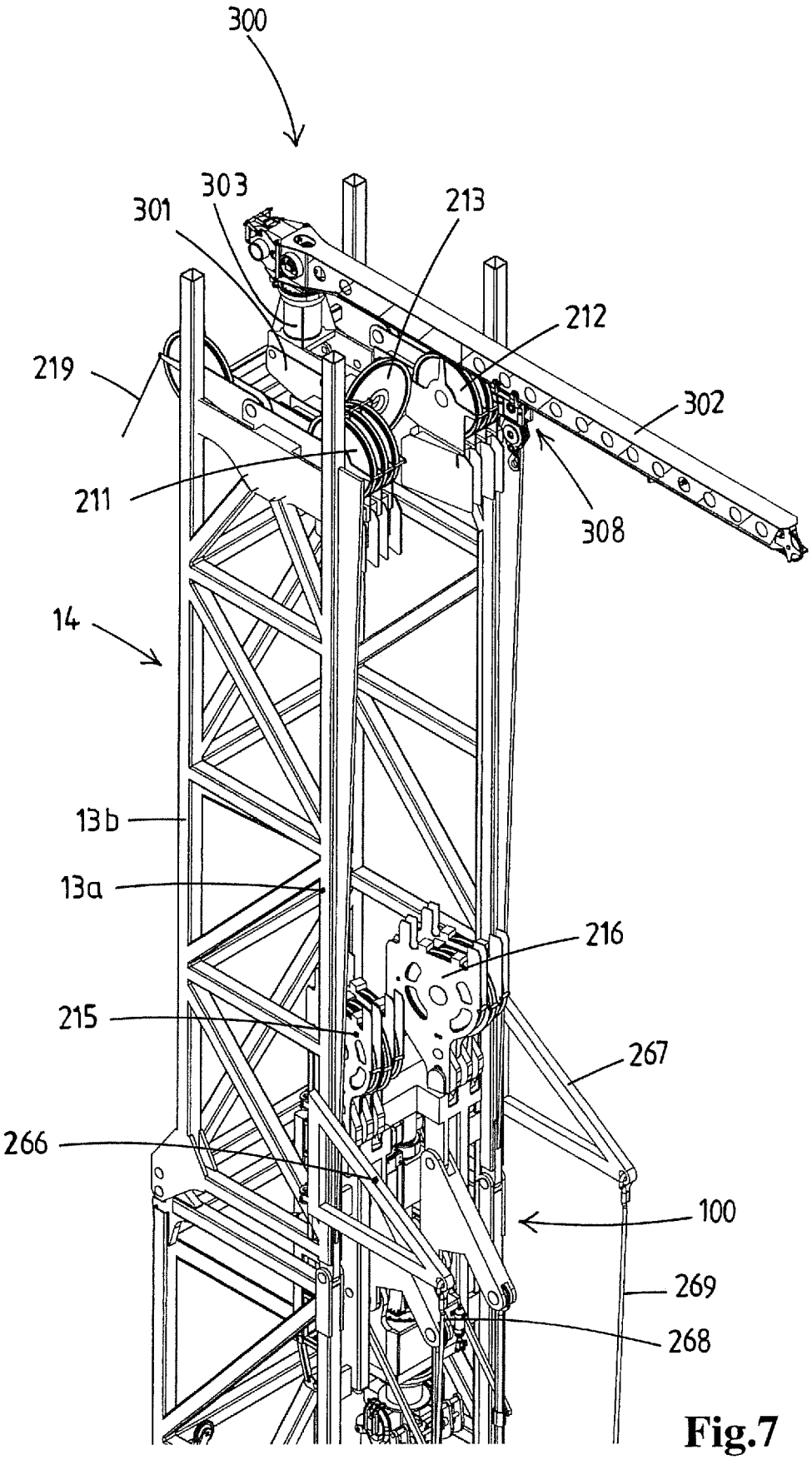
Figure 8:
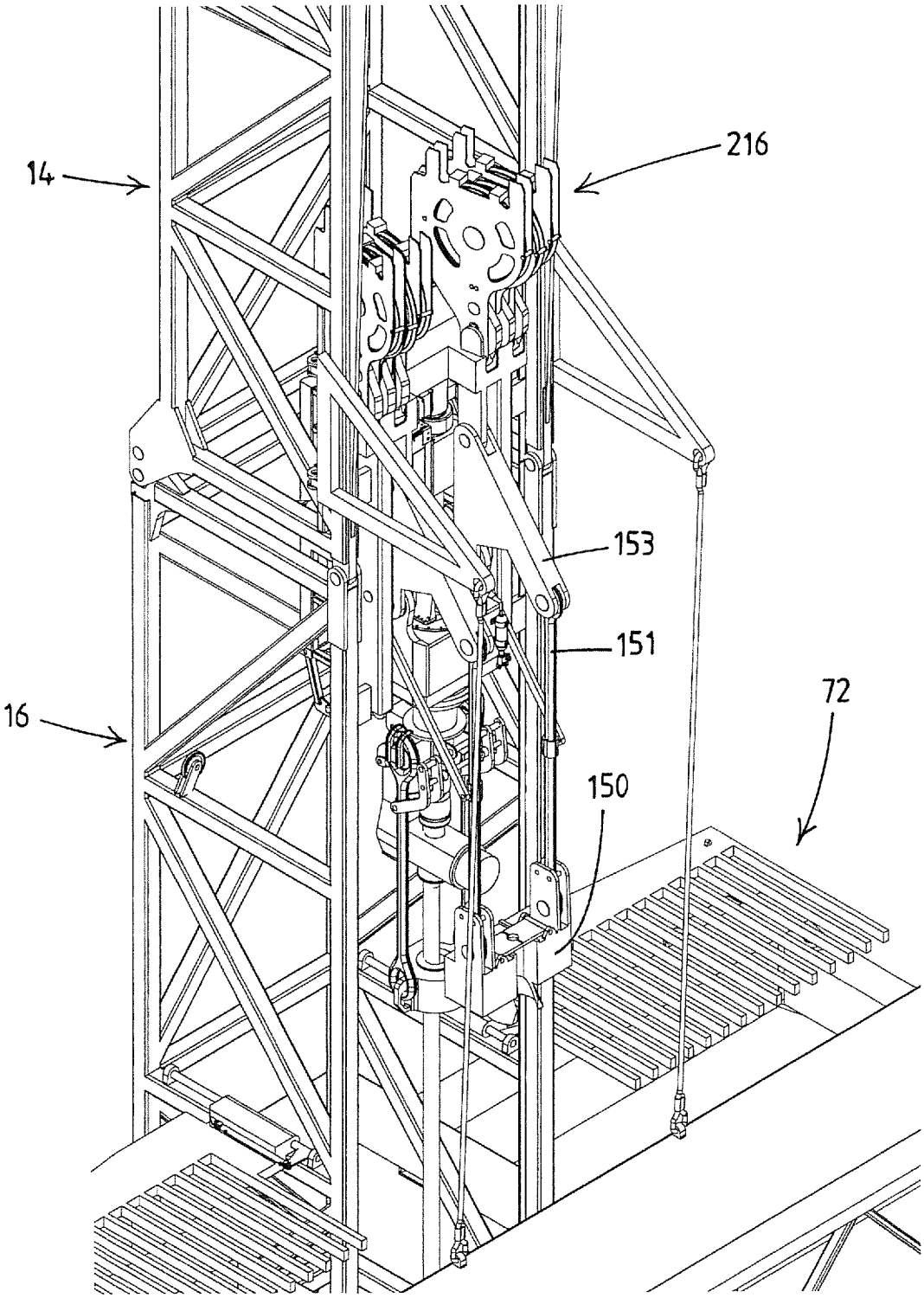
Figure 9D:
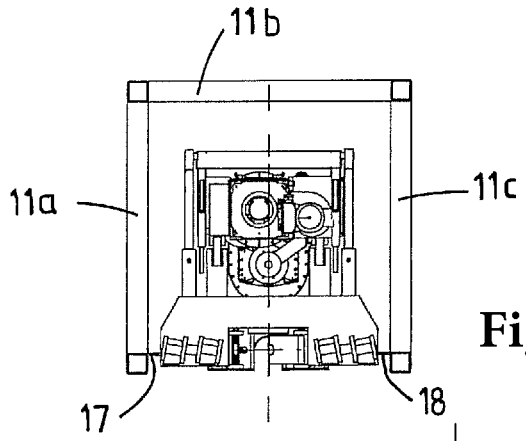
Figure 9C:
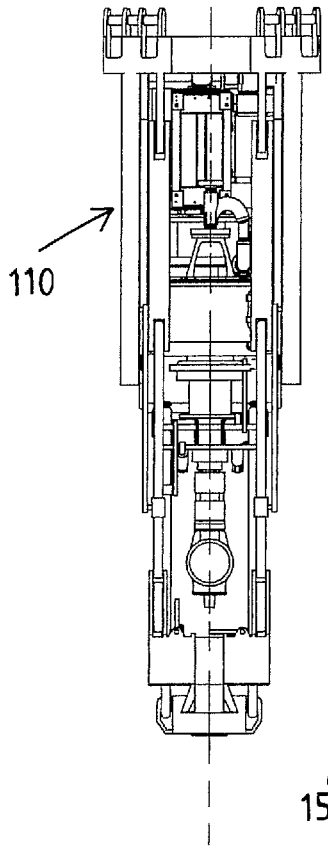
Figure 9B:
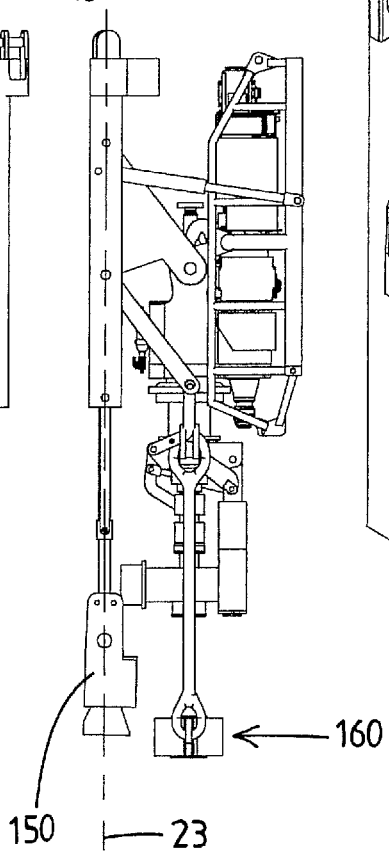
Figure 9A:
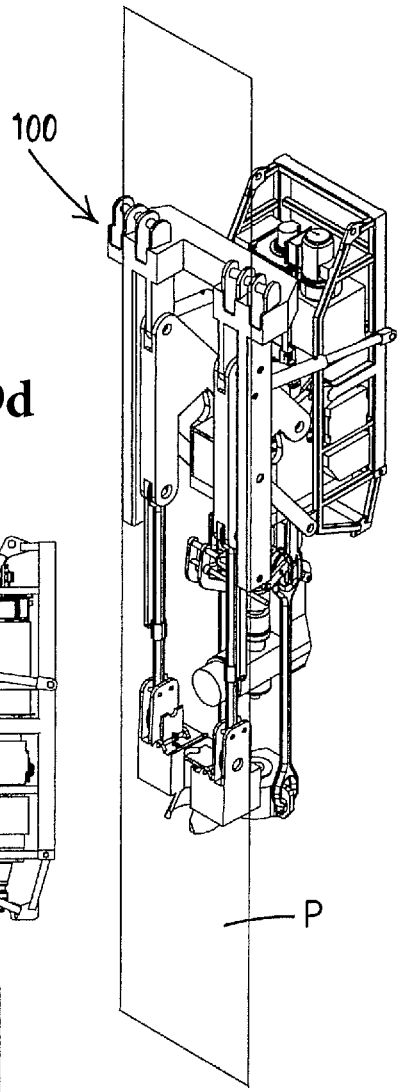
Figure 10:
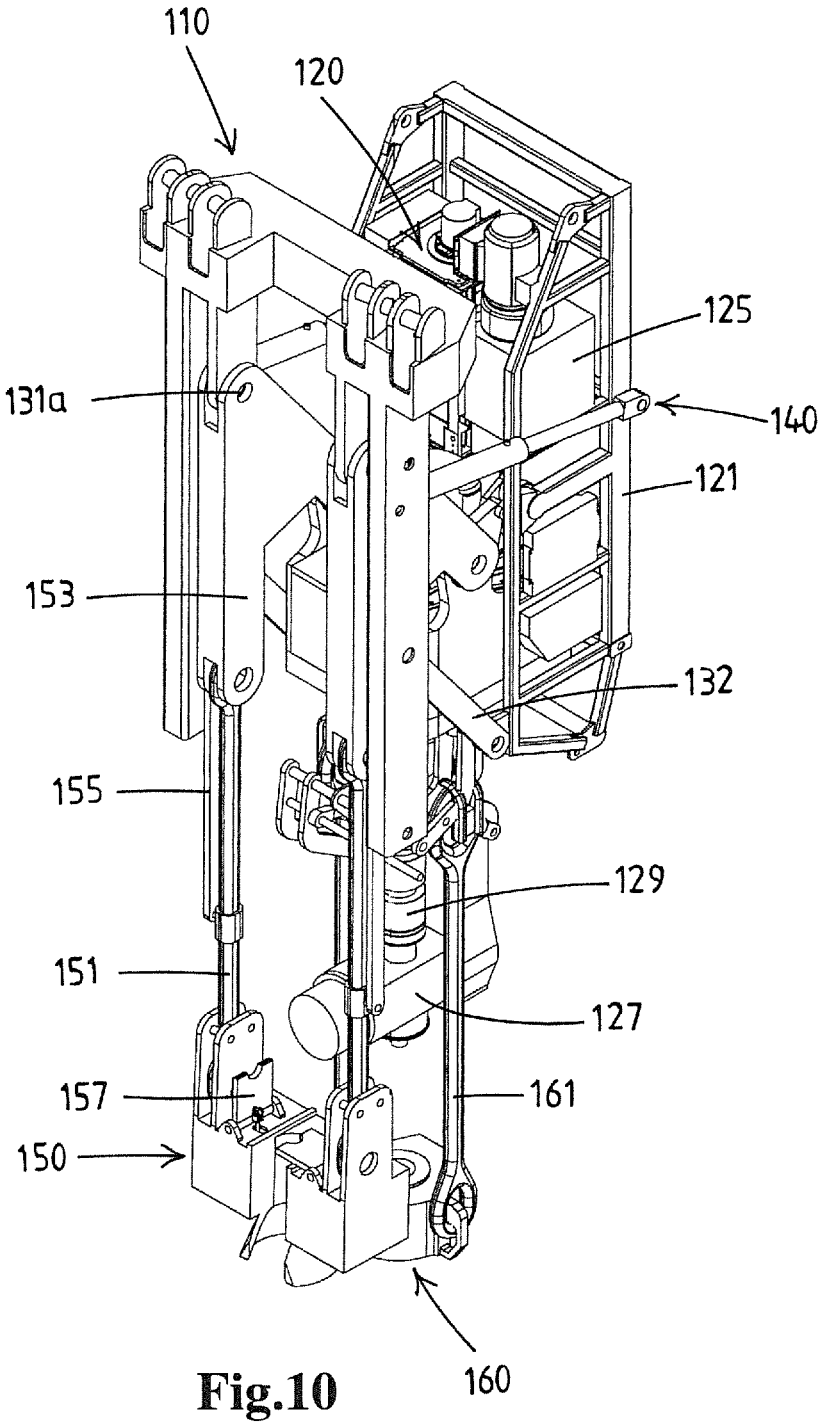
Figures 11, 12:
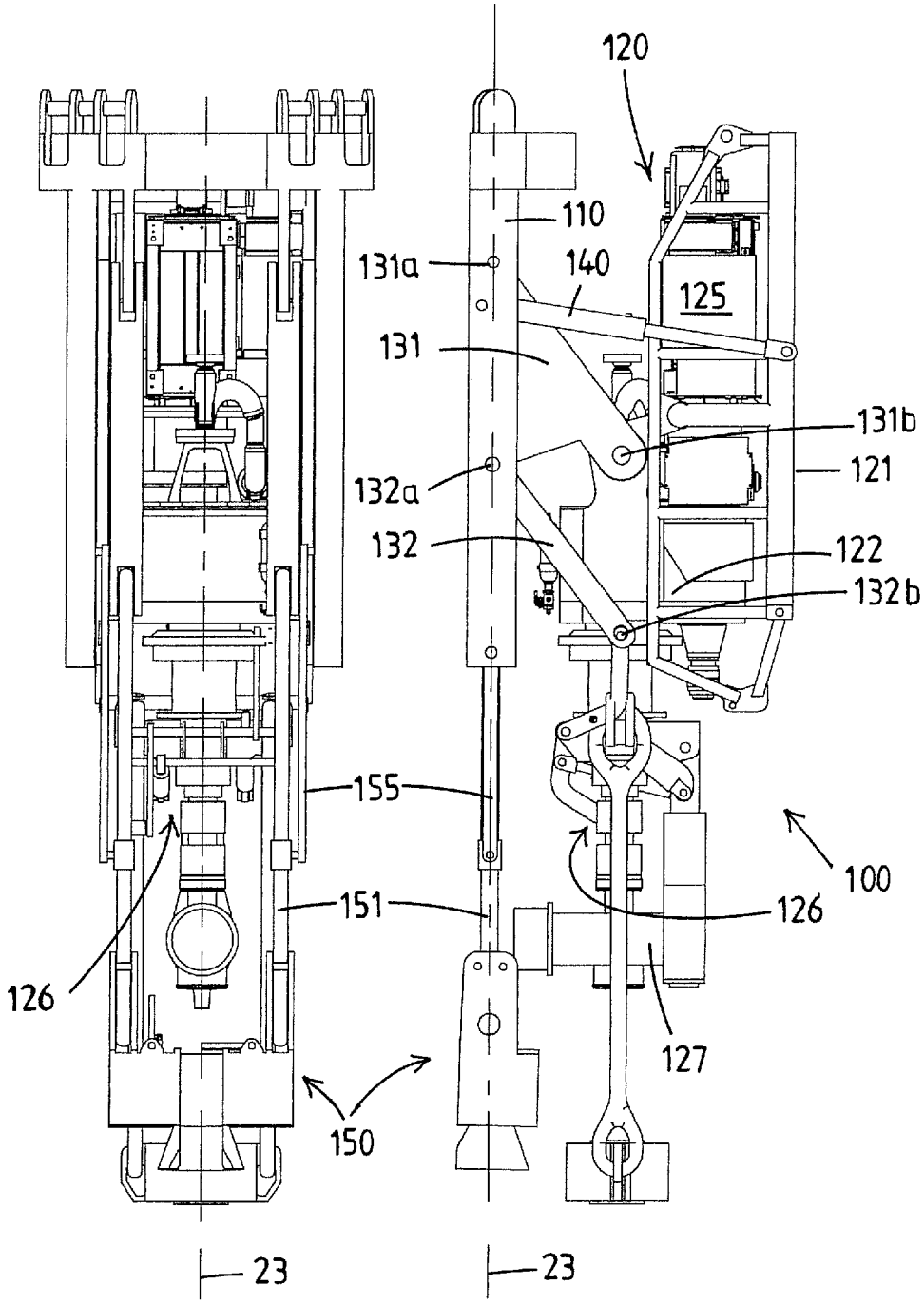
Figure 13:
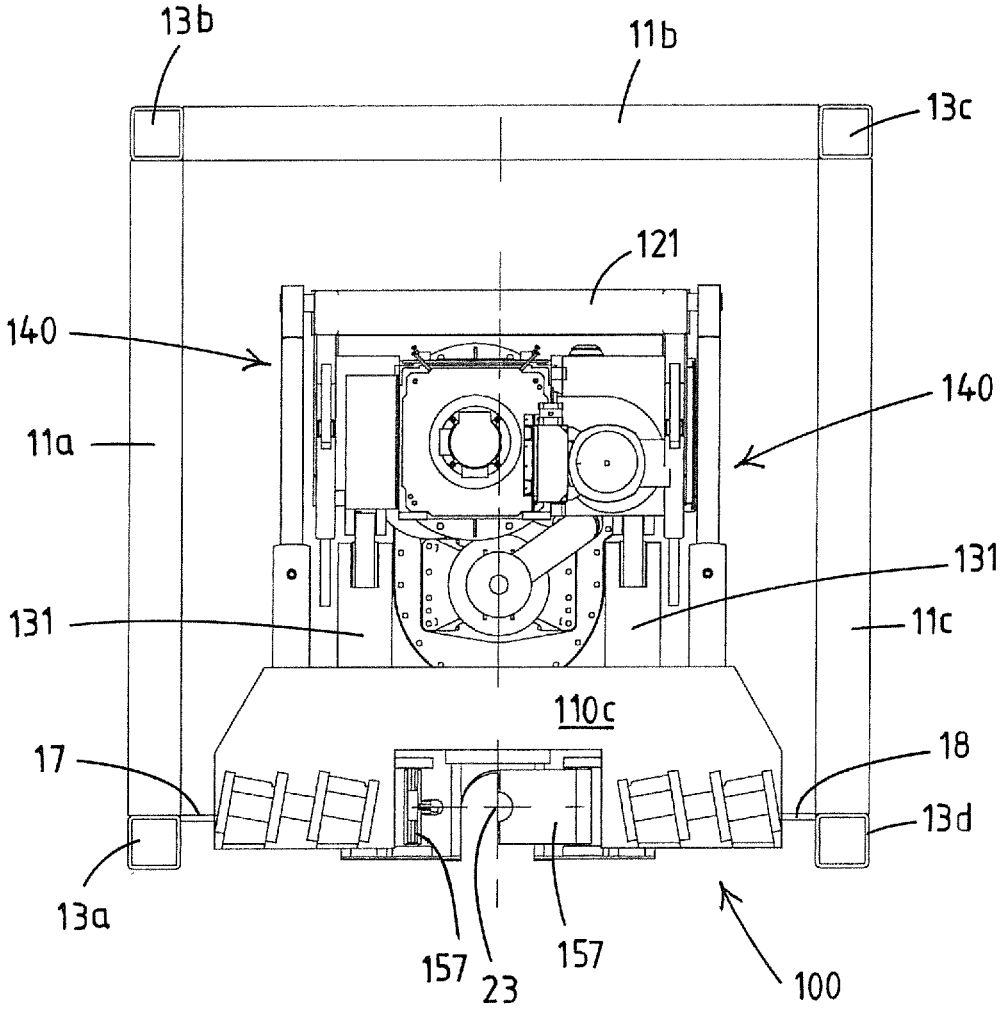
Figure 14D:
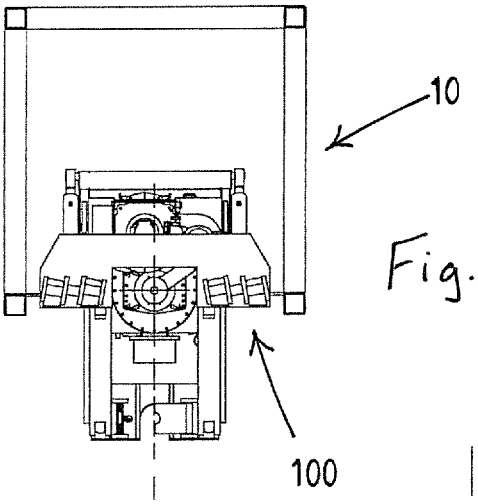
Figure 14A:
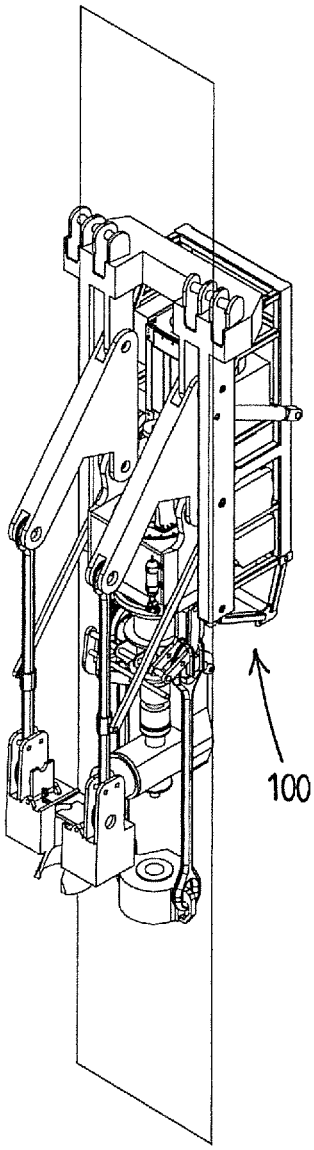
Figure 14C:
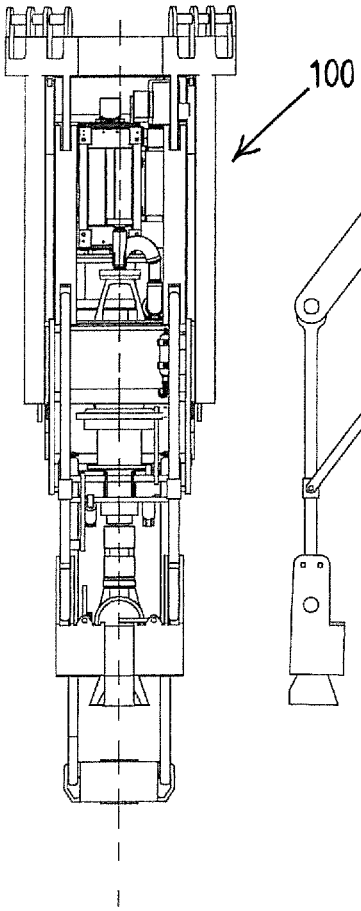
Figure 14B:
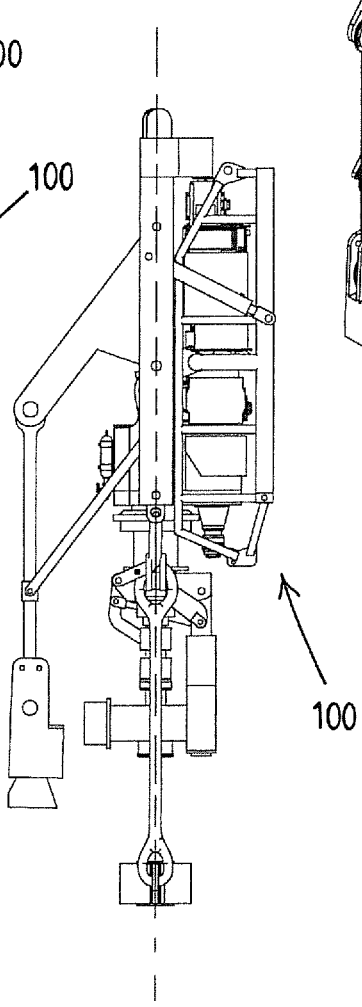
Figure 15:
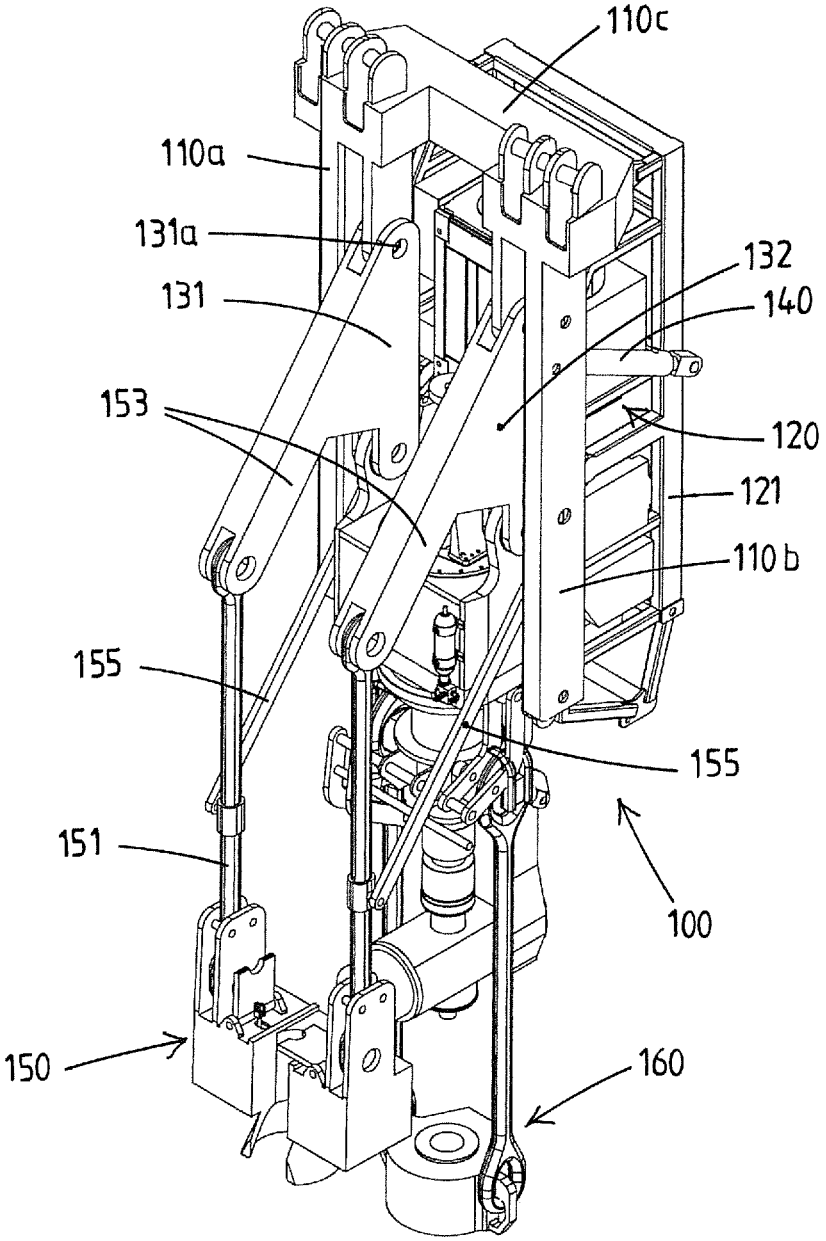
Figure 17:
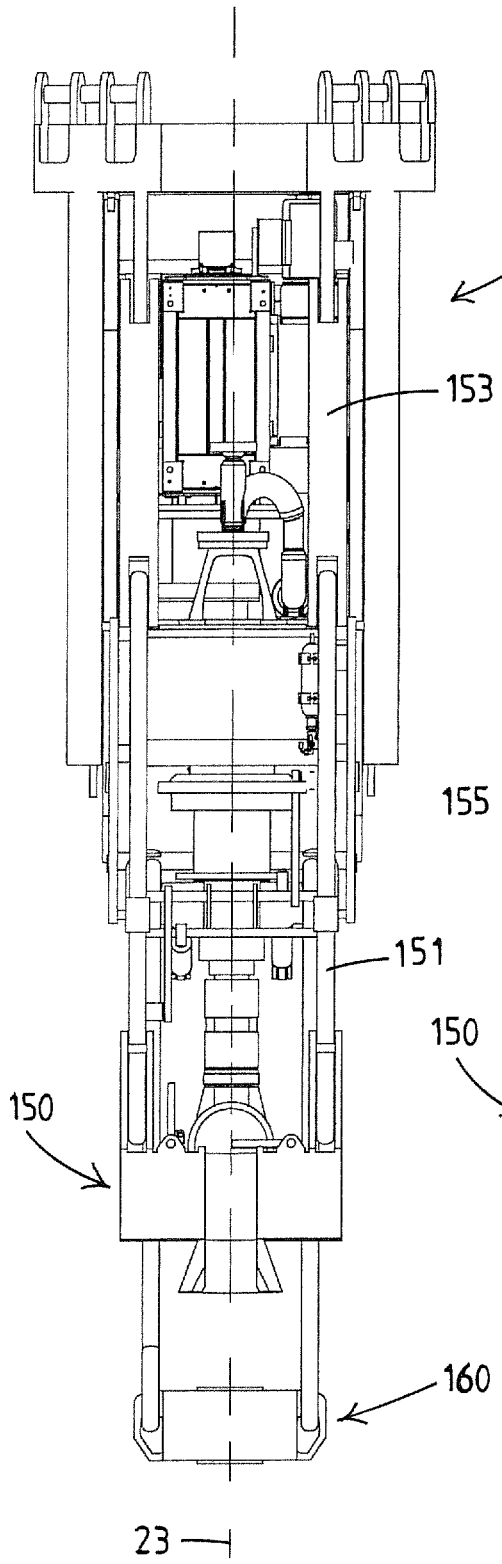
Figure 16:
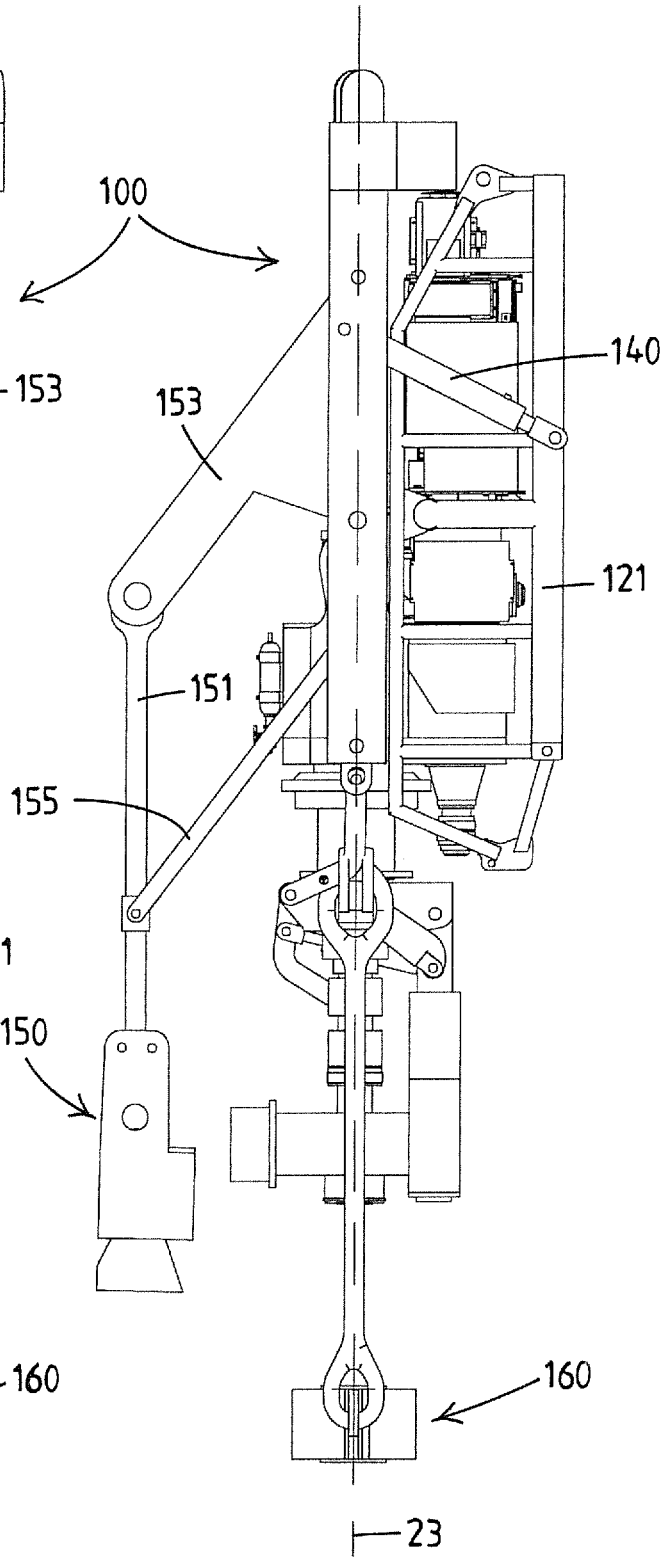
Figure 18:
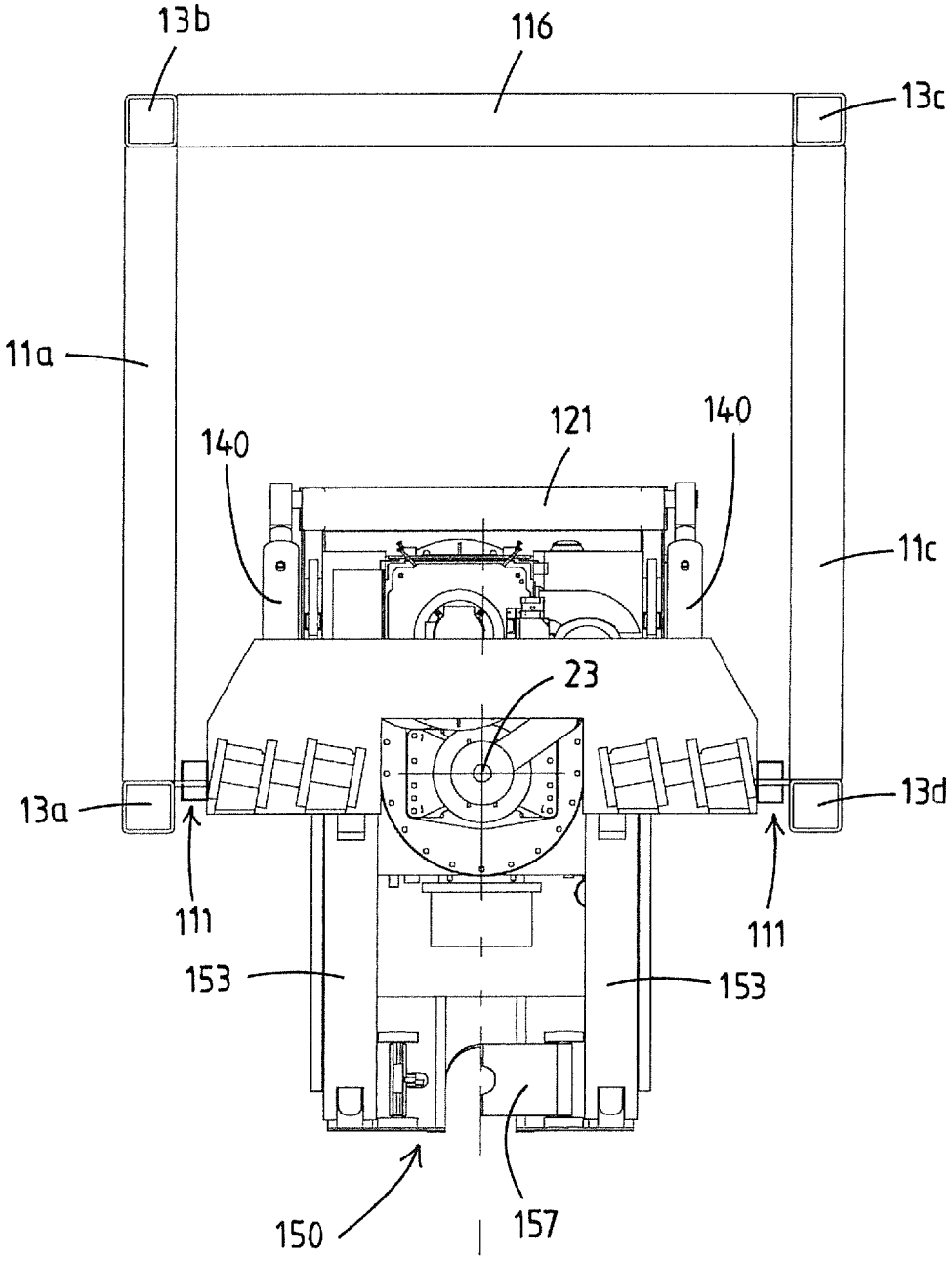
Figure 19:
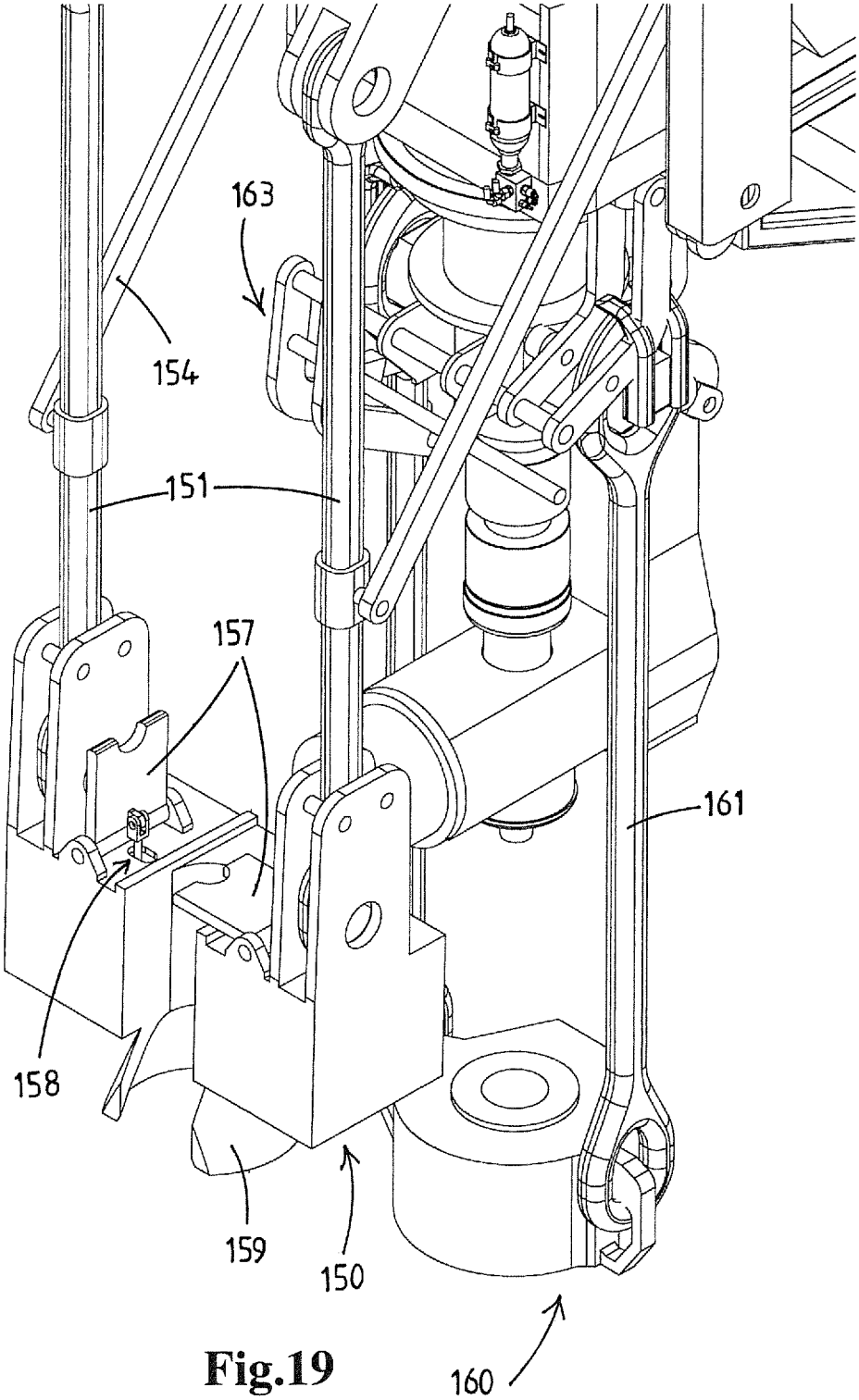

FIG. 3 shows in perspective view an upper part of the rig of FIG. 1 on a larger scale, FIG. 4 shows the part of the rig of FIG. 3 in side view, FIG. 5*a* illustrates in side view the automated racking device of the rig of FIG. 1, FIG. 5*b* illustrates a part of the automated racker of the rig of FIG. 1, FIG. 6 illustrates in front view the automated racking device of the rig of FIG. 1, FIG. 7 shows the crown mast section of the rig of FIG. 1, FIG. 8 shows a part of the mast, the top drive system, and fingerboard devices of the rig of FIG. 1, FIGS. 9*a-d* show various views on the top drive system of the rig of FIG. 1 in the tripping mode, FIG. 10 shows in a perspective view similar to FIG. 9*a* the top drive system in the tripping mode, FIG. 11 shows in a side view similar to FIG. 9*b* the top drive system in the tripping mode, FIG. 12 shows in a front view similar to FIG. 9*c* the top drive system in the tripping mode, FIG. 13 shows in horizontal cross section from above similar to FIG. 9*d* the mast and the top drive system in the tripping mode, FIGS. 14*a-d* show various views on the top drive system of the rig of FIG. 1 in the drilling mode, FIG. 15 shows in a perspective view similar to FIG. 14*a* the top drive system in the drilling mode, FIG. 16 shows in a side view similar to FIG. 14*b* the top drive system in the drilling mode, FIG. 17 shows in a front view similar to FIG. 14*c* the top drive system in the drilling mode, FIG. 18 shows in horizontal cross section from above similar to FIG. 14*d* the mast and the top drive system in the drilling mode, FIG. 19 shows in a perspective view a detail of the top drive system of the rig of FIG. 1, FIGS. 20-25 illustrate the tripping of a drill string by means of the rig of FIG. 1.

FIG. 1 shows a drilling rig 1 for drilling a wellbore and for other wellbore related activities, e.g. for plug and abandonment of non-productive wellbores, well intervention, etc.

In this example the rig 1 is a mobile rig composed of modules that are transportable by road vehicles from one drilling site to another. The invention and aspects thereof may however also be of use in non-mobile rigs and/or non-modular rigs, e.g. rigs with a derrick structure over a moonpool on an offshore drilling vessel.

The rig 1 comprises a drilling tower 10, which is embodied here as a mast. In another embodiment the tower 10 can be embodied as a derrick.

The mast 10 has a U-shaped horizontal cross section with a left-hand mast wall 11*a*, a rear mast wall 11*b*, and a right-hand mast wall 11*c*, and with an open front side 12.

The mast comprises left-hand and right-hand vertical front posts 13*a*, 13*d*, rear corner posts 13*b*, 13*d*. Each front post 13*a, d* is connected by bracings, here a combination of horizontal and diagonal bracings, to a respective rear corner post 13*b*, 13*c* to form the side walls 11*a*, 11*c* of the mast. The rear corner posts 13*b*, 13*c* are also connected by bracings.

In view of the transportation of the drilling rig 1 the mast 10 is composed of multiple sections, including a crown section 14 at the top of the mast, a floor section 15 at the lower, and one or more intermediate mast sections 16. For example, as here, the vertical posts 13*a,b,c,d* are provided with connector members to secure the mast sections one on top of the other.

In this example the floor section 15 is provided at its lower end with a pivot structure 15*a* defining a horizontal pivot axis allowing the mast 10, preferably assembled in horizontal state, to be erected.

The rig 1 comprises a drill floor 20 with a well center 21.

As is preferred a slip device 22 is arranged at the well center 21, e.g. a mechanized and remotely controllable slip device with one or more mobile slip members. The slip device 22 is adapted to support a drill string or other tubular string that extends into the wellbore.

On the drill floor 20 further a tubulars connection makeup and breaking device 25 is arranged near the well center 21, e.g. an iron roughneck machine and/or a mechanized power tong device.

In this example, the drill floor 20 is arranged in a mobile manner on a base structure 30 of the rig so as to be movable between a collapsed or assembly position on the one hand and a raised or operative position relative to the base structure 30 on the other hand (as shown in the figures).

The FIG. 1 illustrates that the base structure comprises a left-hand base member 31 and a right hand base member 32, each composed of two elongated parts 31*a*, 31*b*, 32*a*, 32*b* that are connected end-to-end.

Between the drill floor 20 and each base member 31, 32, here parts 31*a*, 32*a* thereof, two legs 25*a*, 26*a, b* extend that are pivotally connected to both the drill floor and the base member 31, 32 to form a parallelogram. If desired more parallel legs can be provided between each base member and the drill floor.

Each base member 31, 32 is further provided with a telescopic hydraulic cylinder 34, 35 that is connectable to the drill floor 20 for moving the drill floor 20 between the collapsed and raised position thereof. If desired another motorized drive, e.g. including a winch, may be provided for this purpose.

FIG. 1 illustrates the presence of a locking beam 36 to lock the drill floor in its raised position.

The figures illustrate that the base structure, here the members 31, 32, are provided with displacement feet 41, 41 allowing the rig 1, in erected state, to be displaced over the drill site, e.g. from one wellbore to an adjacent wellbore. An example thereof is explained in WO2013/09147 of the present applicant.

The drill floor 20 in its raised position allows for the arrangement of a BOP and/or other wellbore related equipment underneath the drill floor.

The mast, base structure, and/or drill floor of the drilling rig could also be embodied as described in for example WO2013/133698 or in WO2014/178712 of the present applicant.

FIG. 1 also depicts the presence of a tubulars handling device 50 adapted to move tubulars between a vertical position aligned with the firing line through the well center 21 and a horizontal pick-up position. The depicted device is embodied as described in WO2014/133389 of the present applicant, which is incorporated by reference herein. In another embodiment, for example, the tubulars handling device 50 can be designed as described in WO2006/038790 of the present applicant.

FIG. 1 also depicts the presence of a tubulars bin system 60, e.g. in an embodiment as disclosed in WO2013/109148 of the present applicant with bins 61, 62 for storage and transportation of drilling tubulars, e.g. drill pipe joints 3, as well as an arrangement of slide bars 64 that allow for motion of the tubulars between the bins 61, 62 and the tubulars handling device 50.

The mast 10, here intermediate section 16 thereof, is provided with one or more fingerboard devices 71, 72 that are adapted to store drilling tubulars stands 4 assembled from multiple drilling tubulars 3, here three as the stands are so-called triples having a length of about 90 ft.

As illustrated a left-hand fingerboard device 71 is mounted to the left-hand side 11*a* of the mast and a right-hand side fingerboard device 72 is mounted to the right-hand side 11*c* of the mast. Each of these fingerboard devices 71, 72 has fingers defining slots that extend parallel to the respective side of the mast and are open at the front side of the fingerboard device 71, 72.

The lower ends of the store tubulars stands 4 may be supported on a non-depicted lower end support member for the stands.

The rig 1 further comprises a top drive system 100 and a vertical motion drive that is adapted to cause vertical motion of the top drive system 100 relative to the drilling tower 10 in order to perform drilling and tripping operations.

First the top drive system 100 will be discussed. The top drive system 100 comprises:

- a traveling carriage 110 that is vertically mobile along vertical rails 17, 18 of the drilling tower by means of the vertical motion drive,
- a top drive unit 120 that is supported by the carriage 110 and comprises a top drive motor 125 and a rotary torque output member 126, e.g. a rotary stem, that is adapted to be engageable with a top end of a drilling tubulars string extending in the firing line 23 through the well center 21 to impart torque to the drilling tubulars string in order to perform drilling operations,
- a tripping operation elevator 150 that is adapted to be engageable with a drilling tubulars string or drilling tubulars stand 4, e.g. with the top end thereof, in order to perform tripping operations.

The figures illustrate that each of the front vertical posts 13*a, d* of the mast 10 is provided with a corresponding vertical rail 17, 18 that is static in its vertical position, so non-mobile relative to the tower 10.

The carriage 110 is provided with rail followers 111 (see FIG. 18), e.g. rollers and/or glide members, so that the carriage is only vertically mobile up and down relative to the mast, at least over the height of the stands 4 to be handled.

In general terms, as will be explained in more detail below, the top drive unit 120 and the tripping operation elevator 150 are each mobile relative to the traveling carriage 110. Furthermore the top drive system is provided with one or more actuators 140 that are adapted to cause the relative motion of the top drive unit 120 and of the tripping operation elevator 150 so as to provide:

- a drilling mode (see e.g. FIGS. 14*a-d*, 15-18),
- a tripping mode (see e.g. FIGS. 9*a-d*, 10-14).

In the drilling mode the top drive unit 120 is in operative position with the rotary torque output member 126 being aligned with the firing line 23. At the same time the tripping operation elevator 150 is in a non-operative position remote from the firing line 23, here forward of the firing line 23.

In the tripping mode the tripping operation elevator 150 is in operative position aligned with the firing line 23 and at the same time the top drive unit 120 is in a non-operative position, here closer to the rear wall 11*b* of the C-cross section mast than in the operative drilling mode (e.g. compare FIGS. 14 and 18).

As illustrated the top drive system 100 is embodied such that—in the tripping mode—an unobstructed zone is present vertically above the tripping operation elevator 150 that allows the top drive system to be lowered along a drilling tubulars stand 4 in the firing line 23 above the drill floor 20, at least so that the top drive system is below the top end thereof, e.g. allowing lowering till near the drill floor. This will be explained in more detail later in conjunction with the fast tripping sequence depicted in FIGS. 20-25.

The top drive system 100 is also embodied such that—in the tripping mode and with the top drive system lowered at least below the top end of said drilling tubulars stand (see e.g. FIGS. 22, 23, 24)—the drilling tubulars stand 4 is removable from the firing line 23, primarily in lateral direction, to place the drilling tubulars stand 4 in a fingerboard device 71, 72. This allows for a fast tripping process to be conducted.

As illustrated the top drive system 100 here further comprises a drilling operation elevator 160, distinct from the tripping operation elevator 150, which elevator 160 is adapted to retain a drilling tubular or tubular stand 4 in vertical orientation below the rotary output member 126 of the top drive unit 120 in its operative position.

The top drive unit 120 comprises a top drive frame 121 that supports the top drive motor 125, a gear arrangement 122, and the rotary output member 126 that is supported by a bearing.

The top drive unit here further comprises a grabber 127 and a mud saver valve 129 as is known in the art.

The frame 121 is supported on the traveling carriage 110 by a parallelogram mechanism comprising at each of the left-hand side and the right-hand side of the carriage and the frame one pair of upper and lower support arms 131, 132. These arms 131, 132 are each pivotally connected to the carriage and the top drive unit to form four parallel and horizontal pivot axes 131*a*, 131*b*, 132*a*, 132*b*.

The actuators 140, e.g. hydraulic cylinders, are mounted between the traveling carriage 110 and the frame 121. Here one hydraulic cylinder 140 is mounted at the left-hand side and one at the right-hand side of the carriage 110 and the frame 121.

As will be understood suitable actuation of the actuators 140 causes the top drive unit 120 to be displaced relative to the carriage 110 between a position more inward in the mast 10 (closer to the rear wall 11*b* of the mast) and a more forward position wherein the rotary output member 126 is aligned with the firing line 23. As is preferred, even in said more forward position, a major portion of the top drive unit is still within the contour of the mast 10.

The carriage comprises a structural frame with a left-hand carriage frame member 110*a* and a right-hand carriage frame member 110*b* interconnected by one or more transverse frame members 110*c*. These one or more transverse frame members extend rearward of the firing line 23 to provide the mentioned unobstructed zone allowing the lateral removal of the tubulars stand in forward direction.

As illustrated it is envisaged, as is preferred, that the firing line 23 is encompassed in a vertical plane P that extends between the front posts 13*a, d* of the mast 10, possibly between the guide rails 17, 18 so as to reduce any torsional loads.

The tripping operation elevator 150 is suspended by right-hand side and left-hand side links 151 or bails that are each connected at an upper end thereof from a respective pivotal elevator support arm 153 that is pivotally connected to the carriage 110 about a horizontal pivot axis 131*a*.

As illustrated the elevator support arms 153 are each integrated with a respective support arm, here upper support arms 131 at the right-hand side and left-hand side of the carriage 110 so that each pair of an arm 153 and an arm 131 forms a one piece arms member that is pivotal about a horizontal axis 131*a* with the integrated arms 153 and 131 diverging.

The integration of a pair of arms 131, 153 into a one piece integrated pivotal arms member is one manner to achieve that the top drive unit 120 and the tripping operation elevator 150 are mechanically linked so as to move in unison when operating the one or more actuators 140 in order to switch between the mentioned drilling mode and the mentioned tripping mode.

As will be appreciated, by the basically permanent presence of the tripping elevator 150 in the top drive system 100 of the first aspect of the invention, even when not in use when in drilling mode, a fast and efficient switching can be made between the drilling mode and the tripping mode. There is no need to then install the tripping elevator 150 at the time of switching, which is advantageous in view of demands for crew members.

In an embodiment one or more detent devices, e.g. remotely controllable, are provided to secure the top drive unit and/or the support for the tripping elevator relative to the traveling carriage 110 in the drilling mode and the tripping mode. For example one or more mobile detent members, e.g. pins, are provided on the carriage that engage in a corresponding hole in one or more of the support arms.

In an embodiment a linkage member may be provided to force each lower support arm 132 to move in the same direction as the upper support arm 131 when starting to move from a position, here corresponding to the drilling mode, wherein both said upper and lower support arms 131, 132 are vertical. The same effect may also be brought about by another means to force said corresponding motion of the support arms starting from the vertical position. As explained a vertical position of both arms 131, 132 is advantageous in view of the vertical load path. It is, however, also possible that said arms 131, 132 are not completely vertical in said drilling mode.

Of course, e.g. when different dimensions of tubulars to be handled would require a different tripping operation elevator, it is envisaged that the tripping operation elevator may be arranged in an exchangeable manner. For example, as discussed herein, the winch 270 on the racking device can then be used for lifting and handling the rather heavy elevator 150. In a preferred embodiment, as discussed herein, the elevator 150 has a body that is suited to all envisaged tubular diameters to be handled, e.g. just requiring the exchange or adjustment of one or more locking members for adaptation to a specific diameter.

In order to avoid any sway of the tripping operation elevator 150 in the drilling mode the top drive system further comprises a stabilizer rod 155 for each link 151 or bail from which the tripping operation elevator 150 is suspended. The stabilizer rods 155 each have one end that is pivotally connected to the link 151 and another end that is pivotally connected to the carriage 110 so as to form a parallelogram mechanism in combination with the pivotal elevator support arm 153. The stabilizer rods 155 are fixed length in this design. In an alternative a hydraulic cylinder or other telescopic actuator can be provided as stabilizer rod between a link 151 and the carriage 110.

The figures illustrate that the tripping operation elevator 150 comprises a C-shaped body in top view with a laterally open, e.g. to the front, vertical passage 156 through the elevator body that is dimensioned to allow unhindered passage of the elevator body along the drilling tubulars stand 4 in the firing line when the carriage 110 is lowered during tripping out, i.e. clearing any enlarged diameter portion(s) thereon formed by one or more connectors of the drilling tubulars stand.

The figures further illustrate that this elevator 150 comprises one or more mobile, here two pivotal, locking members 157, here on opposite sides of the vertical passage, which in a clearance position thereof (see left-hand locking member in FIG. 10) allow for passage of the enlarged diameter portion(s) during descent of the carriage 110 in tripping and in a locked position (see e.g. FIG. 8) engage underneath a shoulder formed by such an enlarged diameter portion, e.g. connector, e.g. threaded connector, of the tubular in order to allow the tubular, more in particular the tubulars string, to be lifted.

As can be seen e.g. in FIG. 19 two locking members 157 may be provided on the tripping operation elevator 150, each pivotal about a horizontal axis, e.g. each having a tubular facing end with a semi-circular recess adapted to the diameter of the tubular to be handled. As shown an actuator 158 may be provided for each locking member, e.g. allowing for remote control of the locking member.

FIG. 19 illustrates that the tripping elevator is provided with a C-shaped horizontal cross section funnel 159 at its lower end facilitating the sliding of the elevator along the tubulars stand 4 during descent of the carriage 110.

It is illustrated that the drilling operation elevator 160 is equally suspended from links or bails 161 that are here pivotally suspended from the top drive unit 120.

As is known in the field the drilling operation elevator 160 comprises an annular elevator body 162 that can be opened to allow introduction of a tubular in the elevator and then closed to form a closed annular body around the tubular, e.g. an actuator being provided for remote controlled opening and closing of the drilling elevator body. As is known in the field the closed annular elevator body may engage underneath a shoulder formed by an enlarged diameter portion of a tubular, e.g. a connector, e.g. a threaded connector at the end of the tubular.

A motorized tilt mechanism 163 is provided to cause controlled tilting of the links 161 as is known in the art.

In order to move the traveling carriage 110 up and down along the mast 10, the mast crowns section is provided with a crown block assembly 210 with a left-hand set 211 of sheaves and a right-hand set 212 of sheave, which sets are spaced apart from one another seen from the front of the mast so that an opening that is open at the front is present between the two sets, with the firing line 23 passing through this opening.

The sheaves of the sets 211, 212 have horizontal axes generally parallel and in or close to the plane P, here at a small angle. An equalizing sheave 213 of the crown block is provided more rearward, at the rear of the mentioned opening between the sets 211, 212.

The traveling carriage 110 is provided with a left-hand set 215 of sheaves and a right-hand set 216 of sheave with sheaves, which sets sheaves are spaced apart from one another seen from the front of the mast so that an opening that is open at the front is present between the two sets, with the firing line 23 passing through this opening.

As illustrate the set 215 is mounted at the top of frame member 110*a* and the set 216 at the top of frame member 110*b*.

The sheaves on the travelling carriage 110 are also rotatable about a horizontal sheave axis.

The rig 1 is provided with one or more, here two, drawwork winches 217, 218; one on each side of the base structure. Both winches 217, 218 here connect to a single drawwork cable 219 which cable passes over the mentioned sheaves in two multiple fall groups along the right-hand side and left-hand side of the mast, here along the inside of the respective front post 13*a, d*, so as to suspend the traveling carriage 110 from the crown block.

As illustrated it is envisaged that one or more of the sheaves 215, 216 associated with the traveling carriage 110 may each be integrated in a respective detachable sheave block that is individually connectable and detachable, e.g. by remote control from an operator cabin, to the carriage 110 and which, when detached, may be locked (and unlocked), e.g. by remote control from an operator cabin, in an elevated position below the respective set of sheaves of the crown block. This allows to vary the active number of falls from which the carriage is suspended, e.g. allow for faster operation in situations wherein the load requirements are limited and allow for an increased number of active falls when high loads are to be handled.

As explained a left-hand fingerboard device 71 is mounted to the left-hand side 11*a* of the mast and a right-hand side fingerboard device 72 is mounted to the right-hand side 11*c* of the mast 10. As shown each fingerboard device has fingers defining slots that extend parallel to the respective side of the mast and are open at the front side of the fingerboard device to allow for lateral introduction and removal of a tubulars stand from the fingerboard.

As illustrated the drilling rig comprises a tubulars racking device 250 comprising one or more mobile tubulars gripper assemblies adapted to grip a tubular or tubulars stand 4 and move the tubular or tubulars stand between the fingerboard device 71, 72 and the firing line 23.

The tubulars racking device 250 comprises a structural frame supported by the mast 10, mainly at the front side thereof, at an elevated position thereon relative to the drill floor 20.

It is illustrated, see e.g. FIG. 7, that the mast 10 is provided with one or more cantilevers 266, 267 at a height above the structural frame of the racking device 250, here said cantilevers 266 being secured to the front posts 13, d and extending in forward direction.

Between each cantilever 266, 267 and the structural frame of the racking device one or more suspension cables or rods 268, 269 extend so as to provide additional vertical support for the structural frame.

As can be seen e.g. in FIGS. 5*a, b* this structural frame comprises one or more horizontal rails 254, 255 extending across the front side of the mast 10 and across the front sides of the fingerboard devices 71, 72.

The racking device 250 comprising a mobile tubulars gripper assembly 251 guided by said one or more rails 254, 255 and provided with one or more grippers 252, 253 and adapted to grip a tubular stand 4 and move the tubulars stand between the fingerboard devices 71, 72 and the firing line 23. As will be appreciated that the racking device is embodied to allow for passage of the top drive system 100 in its drilling mode and in its tripping mode.

In this example the assembly 251 comprises a vertical carrier beam 256 which is supported by the one or more rails 254, 255 to allow travel in X-direction over said one or more rails 254, 255 and a vertical gripper beam 257 that is connected to the carrier beam 256 by parallelogram arms 258, 259 to allow travel of the grippers 252, 253 in Y-direction, here parallel to the slots in the fingerboards 71, 72.

The gripper beam 257 carries the one or more grippers 252, 253, e.g. one gripper 252 at a fixed location and one being adjustable in vertical direction or both being adjustable in vertical direction relative to the gripper beam, e.g. in view of a controlled vertical stabbing motion by means of a vertical stabbing actuator 260 between the one or more grippers 252, 253 and the beam 257.

As is preferred the racking device 250 is also embodied to allow for vertical motion, in Z-direction, of the gripper beam 257. Here the vertical carrier beam 256 is provided with travellers 256*a*, 256*b* that vertically travel over the beam 256, which each traveller 256*a*, 256*b* having a hinge connected to a respective parallelogram arm 258, 259. A vertical motion actuator for the one or more travellers 256*a*, 256*b* is provided, here a vertically mounted hydraulic cylinder 256*c* between the lowermost traveller 256*a* and the carrier beam 256. This can be best seen in FIG. 5*b*, where the reference numeral is linked to the extended piston rod of the cylinder.

The FIGS. 5*a,b* also illustrate that the mobile tubulars gripper assembly 251 of the tubulars racking device is provided with an auxiliary winch 270 and a winch driven cable 271, here passing over a sheave 272 mounted on the gripper beam 257, e.g. at the lower end thereof.

As the beam 257 is movable in both X and Y directions in a horizontal plane, the sheave 272 and thus the cable 271 is also movable in these X and Y directions. It is envisaged that the mobile tubulars gripper assembly 251 is positionable at least in a position such that the winch driven cable 272 is aligned above the well center 21, so in the firing line 23, and can be lowered to the well center 21 on the drill floor 20 to perform lifting operations above or near the well center using the auxiliary winch 270 on the tubulars racking device. For example a hook is present at the end of cable 271. For example the winch 270 can be used for lifting the slip device 22, e.g. when placed in a corresponding recess in the drill floor.

FIG. 7 illustrates that the tower, here the U-shaped horizontal cross section mast 10, is provided at the top thereof with an auxiliary crane 300 having a base 301 secured to the tower and a crane boom 302 connected via a vertical axis slew bearing 303 to the base 301 allowing to slew the boom, e.g. about a full revolution.

The auxiliary crane 300 comprises a winch 305 and a winch driven cable 306 for hoisting of objects. The auxiliary crane is embodied such that the winch driven cable 306 can be passed vertically along the firing line 23 down to the well center 21 in the tripping mode of the top drive system 110 so as to allow for use of the auxiliary crane 300 for lifting operations at or near, or towards and away from, the well center 21.

Here it is shown that the auxiliary crane 300 is a jib or cantilever crane, wherein the boom 302 extends permanent in horizontal direction and wherein a trolley 308 is displaceable along the boom, with the trolley being provided with a sheave. The trolley 308 is at least positionable so that the winch driven cable 306 passing over the sheave is aligned with the firing line, and a position remote from said firing line position. The trolley could also support a winch with a winch driven cable.

With reference to the illustrations in FIGS. 20-25 now a method for use of the drilling rig of FIG. 1 will be discussed, in particular a method for tripping out a drilling tubulars string from a wellbore.

Figure 20:
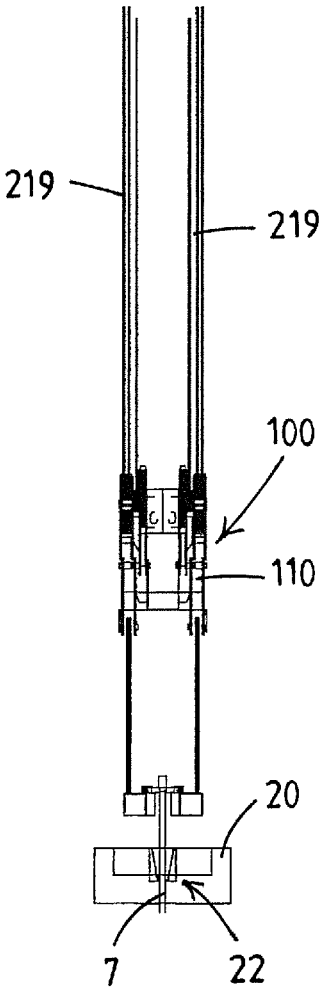

In FIG. 20 a situation is depicted wherein a drilling tubulars string 7 is suspended in the wellbore by means of the slip device 22. A top end portion of the string 7 sticks out above the slip device, which top end (as common) is provided with an enlarged diameter connector.

The top drive system 100 is in the described tripping mode and the traveling carriage 110 has been lowered to an initial engagement level wherein the tripping operation elevator 150 is connected with the top end of the suspended string 7.

Figure 21:
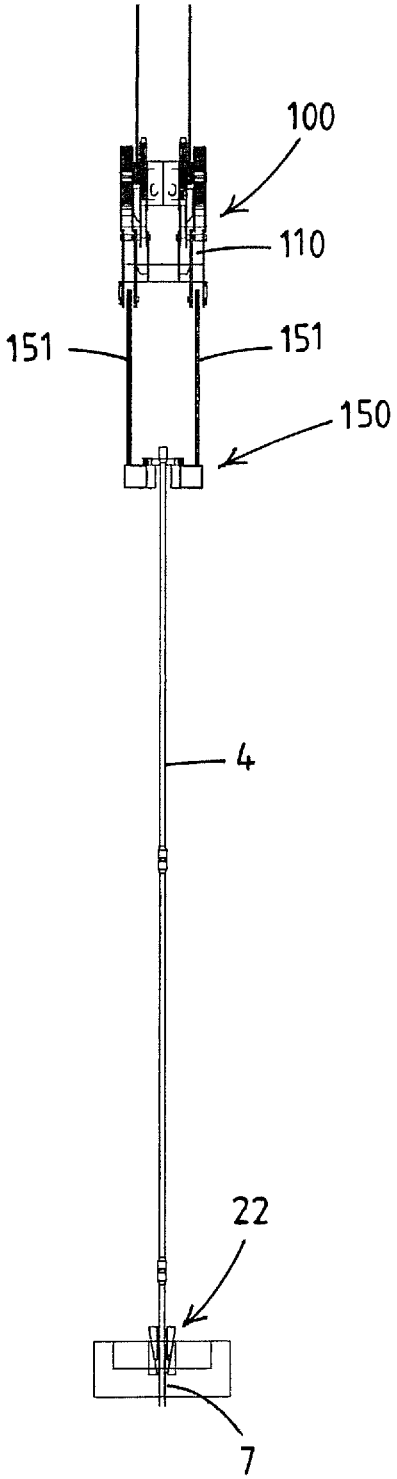

As illustrated in FIG. 21, for tripping out, the slip device 22 has released the string 7 and the carriage 110 has been lifted, so as to pull up a tubulars stand 4 above the well center 21 by means of the elevator 150. In this example a double length stand 4 is pulled, but this could also be a triple stand 4.

The slip device 22 is now operated to reengage on the string 7 so that the string 7, still including the connected stand 4, is vertically retained.

Figure 22:
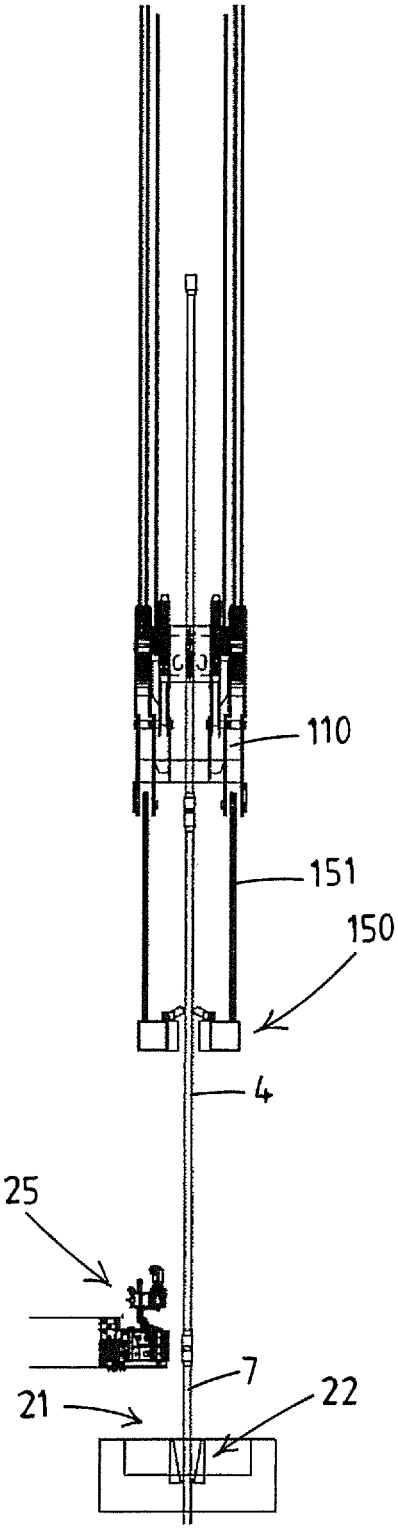
Figure 23:
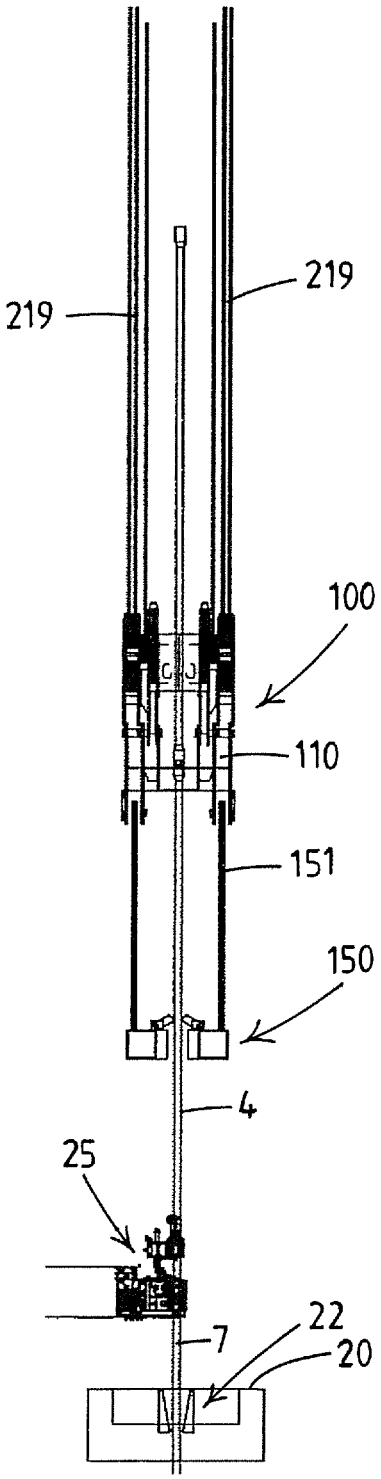
Figure 24:
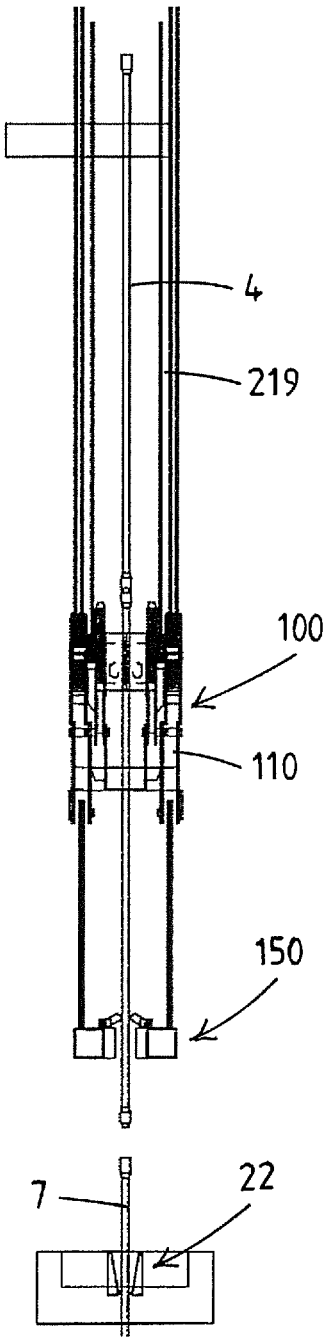

Now the carriage 110 is lowered back towards the initial engagement level. As the stand 4 still is in the firing line 23 the tripping operation elevator 150 slides down along the stand 4. During this lowering step the device 25 is operated to break up the connection between the stand 4 and the rest of the drill string, which includes advancing the device 25 from a parking position to a well center position as is shown in FIGS. 22, 23.

Figure 25:
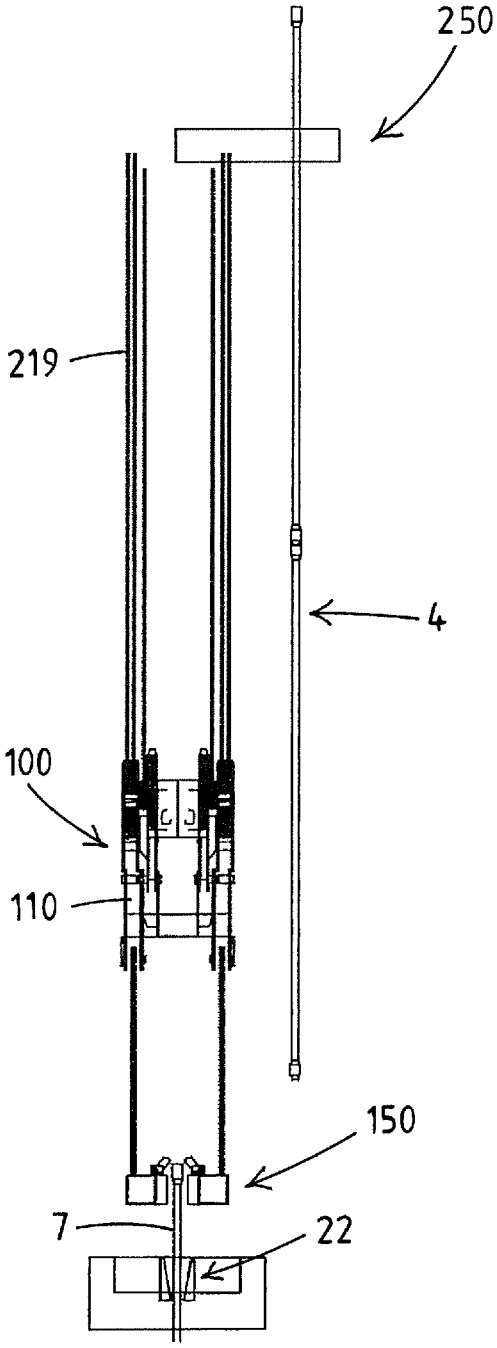

Once the carriage has been lowered enough it becomes possible to engage one or more, e.g. both of the grippers of the racking device 250 (highly schematically shown in FIG. 24) with the stand 4, e.g. the grippers 251, 252 already encircling and/or gripping the stand 4 prior to the actual disconnection. The gripped stand 4 is then raised to complete the disconnection and allow for the racking device to move the stand laterally, e.g. in forward direction, out of the elevator 150 and to store the stand in a fingerboard 71, 72 as schematically depicted in FIG. 25. This may involve actuation of locking members 157 to bring them in the clearance position.

The descent of the carriage 110 is preferably done without pausing, and finally the elevator—with the stand 4 being removed from the firing line—reaches the top end of the suspended string 7 and engages therewith, e.g. by opening and then closing the locking members 157, so as to allow for the lifting of a next stand above the well center 21.

As will be appreciated the operations of the used devices may all be coordinated by one suitably programmed computerized controller, so that the entire tripping process or at least a significant part of the string tripping, may be done in automated manner, e.g. under supervision of one or more operators in an operator cabin, e.g. with a view on the front side of the mast.

It will be appreciated that tripping out is done fast as at least one of the following steps is performed in time overlap with the lowering of the carriage 110:

- disconnecting the lifted tubulars stand 4 from the suspended drill string by means of said tubulars connection makeup and breaking device 25 near the well center,
- removing the disconnected tubulars stand 4 from the firing line, primarily in lateral direction, here by means of the racking device 250,
- placing the drilling tubulars stand in said fingerboard device, here by means of the racking device 250.

For example as soon as the elevator 25 has been lowered along the stand to a level below the grippers of the racking device, the grippers can be made to grip the stand 4 and the device 25 can be operated to disconnect the stand 4 by breaking the lower connection thereof. As soon as the disconnect is brought about, preferably with the elevator 150 still descending, the racking device is operated to move the stand away from the firing line 23. The latter may involve remote control operation of the one or more locking devices 157 to allow the stand to be moved laterally out of the still descending elevator. The racking device 250 can then continue to place the stand 4 in a fingerboard 71, 72 and the elevator 150 can be lowered over the top end of the next stand to be pulled out.

It will also be appreciated that—in the drilling mode—the top drive unit 120 is operable in its normal manner, with the rotary output member aligned with the firing line 23 and with the elevator 150 moved into a non-operative position remote from the firing line.

Preferably all equipment involved in the tripping operation as discussed is connected to a central computerized control unit that is programmed to perform the tripping operation, at least of a major part of the drilling tubulars string 7, fully automated. It is envisaged that in such fully automated tripping sequence one or more operators in an operator cabin merely serve to supervise the process and respond in case of anomalies. In a semi-automated sequence some commands may be given via one or more input devices by the one or more operators, these commands starting parts of the sequence.

The skilled person will appreciate that the described drilling rig also allows for efficient and fast tripping in, which is basically done in reverse order of tripping out.

The invention claimed is:

1. A combination of a drilling mast and a top drive system for a drilling rig having a drill floor with a well center, wherein the drilling mast has a U-shaped horizontal cross section with a left-hand mast wall, a rear mast wall, and a right-hand mast wall, and with an open front side, wherein each of the left-hand mast wall and the right-hand mast wall is provided with one or more vertical rails that are, in use of the drilling rig, parallel to a vertical firing line that extends through the well center, wherein the top drive system comprises:

a traveling carriage that is vertically mobile along the one or more vertical rails of each of the left-hand mast wall and the right-hand mast wall by means of a vertical motion drive, and a top drive unit supported by said carriage and comprising a top drive motor and a rotary torque output member adapted to be engageable with a top end of a drilling tubulars string extending in the firing line through the well center to impart torque to said drilling tubulars string in order to perform drilling operations, wherein a left-hand fingerboard device is mounted to the left-hand mast wall and a right-hand fingerboard device is mounted to the right-hand mast wall, such that the mast is placed in between the left-hand fingerboard device and the right-hand fingerboard device, wherein each fingerboard device has fingers defining slots that extend parallel to the respective mast wall and are open at a front side of each of the left-hand fingerboard device and the right-hand fingerboard device, and wherein the open front side of each of the left-hand fingerboard device and the right-hand fingerboard device is facing the same direction as the open front side of the drilling mast.

2. The combination of claim 1, wherein the combination further comprises a tubulars stand racking device, wherein the racking device comprises a structural frame supported by the mast at an elevated position thereon, wherein said structural frame comprises one or more horizontal rails extending across the front side of the mast and across the front sides of the fingerboard devices, wherein the mast, the well center, the left-hand fingerboard device and the right-hand fingerboard device are all facing the same side of the tubulars stand racking device, said racking device further comprising a mobile tubulars gripper assembly guided by said one or more horizontal rails and provided with one or more grippers and adapted to grip a tubulars stand and move the tubulars stand between each of the fingerboard devices and the firing line.

3. The combination of claim 2, wherein the mast is provided with one or more cantilevers at a height above the structural frame of the tubulars stand racking device, wherein one or more suspension cables or rods extend from the one or more cantilevers to the structural frame so as to provided vertical support for the structural frame.

4. The combination of claim 3, wherein a first cantilever is connected to a front post of the left-hand mast wall and a second cantilever is connected to a front post of the right-hand mast wall.

5. The combination of claim 2, wherein a roof is included on top of the structural frame of the tubulars stand racking device to shield the one or more horizontal rails.

6. A drilling mast for a drilling rig having a drill floor with a well center, wherein the drilling mast has a U-shaped horizontal cross section with a left-hand mast wall, a rear mast wall, and a right-hand mast wall, and with an open front side, wherein a left-hand fingerboard device is mounted to the left-hand mast wall and a right-hand fingerboard device is mounted to the right-hand mast wall, such that the mast is placed in between the left-hand fingerboard device and the right-hand fingerboard device, wherein each fingerboard devices has fingers defining slots that extend parallel to the respective mast wall and are open at a front side of each of the left-hand fingerboard device and the right-hand fingerboard device, wherein the open front side of each of the left-hand fingerboard device and the right-hand fingerboard device is facing the same direction as the open front side of the drilling mast.

7. The drilling mast of claim 6, wherein the mast is provided with a tubulars stand racking device comprising a structural frame that is supported by the mast at an elevated position thereon, wherein said structural frame comprises one or more horizontal rails extending across the front side of the mast and across the front sides of the fingerboard devices, wherein the mast, the well center, the left-hand fingerboard device and the right-hand fingerboard device are all facing the same side of the tubulars stand racking device, said racking device further comprising a mobile tubulars gripper assembly guided by said one or more horizontal rails and provided with one or more grippers and adapted to grip a tubulars stand and move the tubulars stand between each of the fingerboard devices and the firing line.

8. A drilling mast for a drilling rig having a drill floor with a well center, wherein the drilling mast has a U-shaped horizontal cross section with a left-hand mast wall, a rear mast wall, and a right-hand mast wall, and with an open front side, wherein the mast is provided with a left-hand fingerboard device mounted to the left-hand mast wall and a right-hand fingerboard device is mounted to the right-hand mast wall, such that the mast is placed in between the left-hand fingerboard device and the right-hand fingerboard device, wherein an open front side of each of the left-hand fingerboard device and the right-hand fingerboard device is facing the same direction as the open front side of the drilling mast, wherein each fingerboard device has fingers defining slots, wherein the mast is provided with a racking device which comprises a structural frame supported by the mast at an elevated position thereon, wherein said structural frame comprises one or more horizontal rails, said racking device further comprising a mobile tubulars gripper assembly guided by said one or more horizontal rails and provided with one or more grippers and adapted to grip a tubulars stand and move the tubulars stand between each of the fingerboard devices and the firing line, wherein the mast is provided with one or more cantilevers at a height above the structural frame of the racking device, and wherein one or more suspension cables or rods extend from the one or more cantilevers to the structural frame so as to provided vertical support for the structural frame.

9. A drilling tower for a drilling rig having a drill floor with a well center, wherein the tower is provided with at least one fingerboard device, wherein each fingerboard device has fingers defining slots, wherein the drilling tower is provided with a racking device comprises a structural frame supported by the tower at an elevated position thereon relative to the drill floor, wherein said structural frame comprises one or more horizontal rails, said racking device further comprising a mobile tubulars gripper assembly guided by said one or more horizontal rails and provided with one or more grippers and adapted to grip a tubular or tubulars stand and move the tubular or tubulars stand between the fingerboard device and a firing line through the well center, wherein the racking device is provided with an auxiliary winch having a winch driven cable, which auxiliary winch is embodied so that the winch driven cable is alignable with the firing line through the well center and can be lowered to the well center on the drill floor in order to perform lifting operations above or near the well center using the racking device auxiliary winch, wherein the drilling tower is a mast having a U-shaped horizontal cross section with a left-hand mast wall, a rear mast wall, and a right-hand mast wall, and with an open front side, and the mast is provided with a left-hand fingerboard device mounted to the left-hand wall of the mast and a right-hand fingerboard device mounted to the right-hand wall of the mast, and wherein an open front side of each of the left-hand fingerboard device and the right-hand fingerboard device is facing the same direction as the open front side of the drilling mast.

10. The drilling tower of claim 9, wherein the racking device is adapted to grip a tubular or tubulars stand and move the tubular or tubulars stand between each of the fingerboard devices and a firing line through the well center.

* * * * *